US008676085B1

(12) United States Patent
Batori et al.

(10) Patent No.: US 8,676,085 B1
(45) Date of Patent: Mar. 18, 2014

(54) DISMOUNTING AND MOUNTING METHODS FOR COUPLING AND ELECTROPHOTOGPHAPHIC PHOTOSENSITIVE DRUM UNIT

(71) Applicant: Canon Kabushiki Kaisha, Tokyo (JP)

(72) Inventors: Yoshiyuki Batori, Mishima (JP); Nobuyoshi Hara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/096,669

(22) Filed: Dec. 4, 2013

Related U.S. Application Data

(62) Division of application No. 14/031,192, filed on Sep. 19, 2013, which is a division of application No. 13/773,856, filed on Feb. 22, 2013, now Pat. No. 8,565,640, which is a division of application No. 12/981,683, filed on Dec. 30, 2010, now Pat. No. 8,406,656, which is a division of application No. 12/483,718, filed on Jun. 12, 2009, now Pat. No. 7,885,575.

(30) Foreign Application Priority Data

Jun. 20, 2008 (JP) ..... 2008-161527
Aug. 11, 2008 (JP) ..... 2008-207291

(51) Int. Cl.
*G03G 21/00* (2006.01)
*G03G 15/00* (2006.01)

(52) U.S. Cl.
USPC ..... 399/111; 399/113; 399/116; 399/117

(58) Field of Classification Search
USPC ..... 399/111, 113, 116, 117, 119, 167
See application file for complete search history.

(56) References Cited

U.S. PATENT DOCUMENTS 5,911,096 A 6/1999 Batori et al.
5,920,753 A 7/1999 Sasaki et al.
5,930,562 A 7/1999 Noda et al.
5,937,237 A 8/1999 Nonaka et al.

(Continued)

FOREIGN PATENT DOCUMENTS

EP 0 622 698 12/1994
EP 1 241 535 3/2002

(Continued)

OTHER PUBLICATIONS

PCT International Search Report and Written Opinion of International Search Authority in PCT/JP2009/061266, issued Sep. 2, 2009.

(Continued)

*Primary Examiner* — Mark R Gaworecki
(74) *Attorney, Agent, or Firm* — Fitzpatrick, Cella, Harper & Scinto

(57) ABSTRACT

An electrophotographic photosensitive drum unit includes a cylinder having a photosensitive layer at an outer periphery thereof and a drum flange provided at one end of the cylinder. The drum flange includes at least two projections provided inside of the drum flange and projected radially inwardly of the drum flange, with a space diametrically between the two projections. Each of the two projections projects radially inwardly of the drum flange to a greater extent at a position farther from the cylinder than it does at a position closer to the cylinder. Each of the two projections is provided with a recess to facilitate deformation of the projection.

9 Claims, 15 Drawing Sheets

(56) References Cited

U.S. PATENT DOCUMENTS

| | | | |
|---|---|---|---|
| 5,940,658 | A | 8/1999 | Yokoi et al. |
| 6,075,957 | A | 6/2000 | Batori et al. |
| 6,101,348 | A | 8/2000 | Nonaka et al. |
| 6,131,007 | A | 10/2000 | Yamaguchi et al. |
| 6,275,668 | B1 | 8/2001 | Batori |
| 6,334,035 | B1 | 12/2001 | Abe et al. |
| 6,363,226 | B1 | 3/2002 | Batori |
| 6,464,589 | B1 | 10/2002 | Shinozuka |
| 6,643,482 | B2 | 11/2003 | Higeta et al. |
| 6,714,746 | B2 | 3/2004 | Morioka et al. |
| 6,937,832 | B2 | 8/2005 | Sato et al. |
| 6,963,706 | B2 | 11/2005 | Morioka et al. |
| 7,079,787 | B2 | 7/2006 | Ogina et al. |
| 7,127,192 | B2 | 10/2006 | Batori et al. |
| 7,136,604 | B2 | 11/2006 | Chadani et al. |
| 7,200,349 | B2 | 4/2007 | Sato et al. |
| 7,418,225 | B2 | 8/2008 | Morioka et al. |
| 7,630,667 | B2 | 12/2009 | Huang et al. |
| 2006/0240896 | A1 | 10/2006 | Ohashi et al. |
| 2007/0237545 | A1 | 10/2007 | Cho et al. |
| 2008/0152388 | A1 | 6/2008 | Ueno et al. |

FOREIGN PATENT DOCUMENTS

| | | | |
|---|---|---|---|
| EP | 1 791 034 | A1 | 5/2007 |
| JP | 60-249720 | A | 10/1985 |
| JP | 2006-072160 | | 3/2006 |
| RU | 2 289 835 | | 12/2006 |

OTHER PUBLICATIONS

Office Action in Australian Patent Application No. 2009169328, dated May 6, 2011.

Office Action in Canadian Patent Application No. 2,728,434, mailed Jul. 11, 2012.

Notice of Allowance in Korean Patent Application No. 10-2011-700807,mailed Jan. 29, 2013.

Jan. 18, 2012 Decision on Grant in Russian Patent Application No. 201110893/28(002461), with English translation.

Office Action in Taiwanese Patent Application No. 098119938, mailed Mar. 20, 2013 (with English translation).

Decision on Grant in Russian Patent Application No. 2012111801/12(017780), issued Sep. 26, 2013 (with English translation).

DISMOUNTING AND MOUNTING METHODS FOR COUPLING AND ELECTROPHOTOGPHAPHIC PHOTOSENSITIVE DRUM UNIT

FIELD OF THE INVENTION AND RELATED ART

The present invention relates to a dismounting method for a coupling member, a mounting method for a coupling member, and an electrophotographic photosensitive drum unit used for a process cartridge dismountably mounted to a main assembly of an electrophotographic image forming apparatus. Here, in the present invention, the process cartridge contains as a unit at least one of an electrophotographic photosensitive member drum, developing means as process means actable on the drum, cleaning means, and charging means. And, it is detachably mountable to the electrophotographic image forming apparatus main assembly.

In addition, the electrophotographic image forming apparatus forms an image on a recording material through an electrophotographic type process. As examples of the electrophotographic image forming apparatus, there are an electrophotographic copying machine, an electrophotographic printer (LED printer, a laser beam printer), a facsimile device, a word processor, and so on.

In addition, the main assembly of the electrophotographic image forming apparatus is a portion of the electrophotographic image forming apparatus except the process cartridge.

In a known electrophotographic image forming apparatus in which the electrophotographic image forming process is used the electrophotographic photosensitive member drum, and the process means actable on the electrophotographic photosensitive member drum are integrated into a cartridge as a unit. And, this cartridge is detachably mountable to the main assembly of the electrophotographic image forming apparatus process cartridge type.

According to this process cartridge type the maintenance of the image forming apparatus can be carried out by the user himself or herself without relying on the service person, and therefore, the operativity of the maintenance is remarkably improved.

In addition, in the electrophotographic image forming apparatus, an image is formed on a recording material using a developer. The developer contained in the developer accommodating portion is consumed as the process cartridge having the developing means repeats the image formation.

Simple disassembling, and remanufacturing methods for making usable again the process cartridge from which the developer has been consumed to such an extent that the image of the quality which can satisfy the user cannot be formed, are desired. And, an example of such a method is disclosed in U.S. Pat. No. 6,643,482.

The easy assembling method of the process cartridge has been desired.

The present invention further develops the above described prior art.

SUMMARY OF THE INVENTION

Accordingly, it is a principal object of the present invention to provide an easy dismounting method for a coupling member.

It is another object of the present invention to provide an easy mounting method for a coupling member.

It is a further object of the present invention to provide an electrophotographic photosensitive drum unit, wherein dismounting of the coupling is easy.

It is a further object of the present invention to provide an electrophotographic photosensitive drum unit, wherein mounting of the coupling is easy.

According to an aspect of the present invention, there is provided a coupling member dismounting method for dismounting, from a drum flange mounted to an electrophotographic photosensitive drum usable with a process cartridge which is detachably mountable to a main assembly of an electrophotographic image forming apparatus, a coupling member for receiving a rotating force for rotating the electrophotographic photosensitive drum from the main assembly of the apparatus in a state in which the process cartridge is mounted to the main assembly of the apparatus, said method comprising (i) an inclining step of inclining the coupling member relative to a rotational axis of the drum flange, wherein the coupling member includes a rotating force receiving member having, at a free end portion, a rotating force receiving portion for receiving the rotating force, a spherical portion mounted to a rear end portion of the rotating force receiving member by a pin penetration; (ii) a pin urging step of pushing the pin from one end to the other end thereof, wherein said one and the other ends of the pin are projected out of the spherical portion in a state in which the coupling member is inclined by said inclining step; wherein a regulating portion provided along an inside of the drum flange with a gap between the spherical portion and the regulating portion and has a configuration nearer to a spherical surface of the free end portion than a flat plane which is perpendicular to a longitudinal direction of the electrophotographic photosensitive drum and which passes through a center of the spherical portion, and wherein said regulating portion includes a first surface extending from the regulating portion in a direction away from the coupling member toward the free end portion with respect to the longitudinal direction, and a second surface bent from the first surface extending from the regulating portion in a direction away from the coupling member toward the free end portion with respect to the longitudinal direction, (iii) a pin riding step of making a part of the pin which is further projected at the end by said pin urging step ride on the second surface; and (iv) a coupling member dismounting step of dismounting the coupling member from the drum flange by applying a force to a free end portion of the coupling member toward a fulcrum which is the portion of the pin riding on the second surface.

According to another aspect of the present invention, there is provided a coupling member dismounting method for dismounting, from a drum flange mounted to an electrophotographic photosensitive drum usable with a process cartridge which is detachably mountable to a main assembly of an electrophotographic image forming apparatus, a coupling member for receiving a rotating force for rotating the electrophotographic photosensitive drum from the main assembly of the apparatus in a state in which the process cartridge is mounted to the main assembly of the apparatus, wherein the coupling member includes a rotating force receiving member having, at a free end portion, a rotating force receiving portion for receiving the rotating force, a resin spherical portion mounted to a rear end portion of the rotating force receiving member by a pin penetration, wherein said; the coupling member is mounted to a drum flange, mounted to one end of the electrophotographic photosensitive drum, by a resin regulating portion which is provided inside the drum flange and which is projected inwardly with respect to a radial direction of the drum flange with a gap between the spherical portion and the regulating portion, said method comprising (i) a gripping step of gripping the rotating force receiving member of the coupling member; (ii) a coupling member dismounting step of dismounting the coupling member, from the resin regulating portion, the resin spherical portion while deforming at least one of the resin regulating portion and the resin spherical portion by applying a force toward the free end portion in a state in which the rotating force receiving member is gripped by said gripping step.

According to a further aspect of the present invention, there is provided a coupling member mounting method for mounting, to a drum flange mounted to an electrophotographic photosensitive drum usable with a process cartridge which is detachably mountable to a main assembly of an electrophotographic image forming apparatus, a coupling member for receiving a rotating force for rotating the electrophotographic photosensitive drum from the main assembly of the apparatus in a state in which the process cartridge is mounted to the main assembly of the apparatus, wherein the coupling member includes a rotating force receiving member having, at a free end portion, a rotating force receiving portion for receiving the rotating force, a resin spherical portion mounted to a rear end portion of the rotating force receiving member by a pin penetration, wherein said; the coupling member is mounted to a drum flange, mounted to one end of the electrophotographic photosensitive drum, by a resin regulating portion which is provided inside the drum flange and which is projected inwardly with respect to a radial direction of the drum flange with a gap between the spherical portion and the regulating portion, said method comprising a coupling member mounting step of mounting the coupling member, into the resin regulating portion, the resin spherical portion while deforming at least one of the resin regulating portion and the resin spherical portion by pushing it longitudinally inwardly of the electrophotographic photosensitive drum.

According to a further aspect of the present invention, there is provided an electrophotographic photosensitive drum unit to which a coupling member is mountable, wherein said coupling member includes, at a free end portion, a rotating force receiving member for receiving, from an electrophotographic image forming apparatus, a rotating force for rotating an electrophotographic photosensitive drum, a spherical portion mounted to a rear end portion of the rotating force receiving member by a pin penetration, said electrophotographic photosensitive drum unit comprising a cylinder having a photosensitive layer at an outer periphery thereof; and a drum flange provided at one end of said cylinder, said drum flange including, a plurality of resin regulating portions provided inside said drum flange and projected radially inwardly of the drum flange, wherein said regulating portions are effective to regulate movement of said spherical portion in a longitudinal direction of said drum unit when said coupling member is mounted thereto; a recess provided in said regulating portion at a position radially outside of said drum flange, for facilitating deformation of said regulating portion radially outwardly of said drum flange; and a plurality of rotating force receiving portion including a pin for receiving the rotating force, wherein said pin is provided between adjacent ones of said regulating portions.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Referring to the accompanying drawings, the preferred embodiments of the present invention will be described. The function, material, configuration, positional relations and the like of the elements described hereinbelow is not limiting to the present invention unless otherwise stated. As for the material, configuration and the like of the elements described once apply to the subsequent descriptions unless otherwise stated.

Embodiment

General Arrangement

Figure 1:
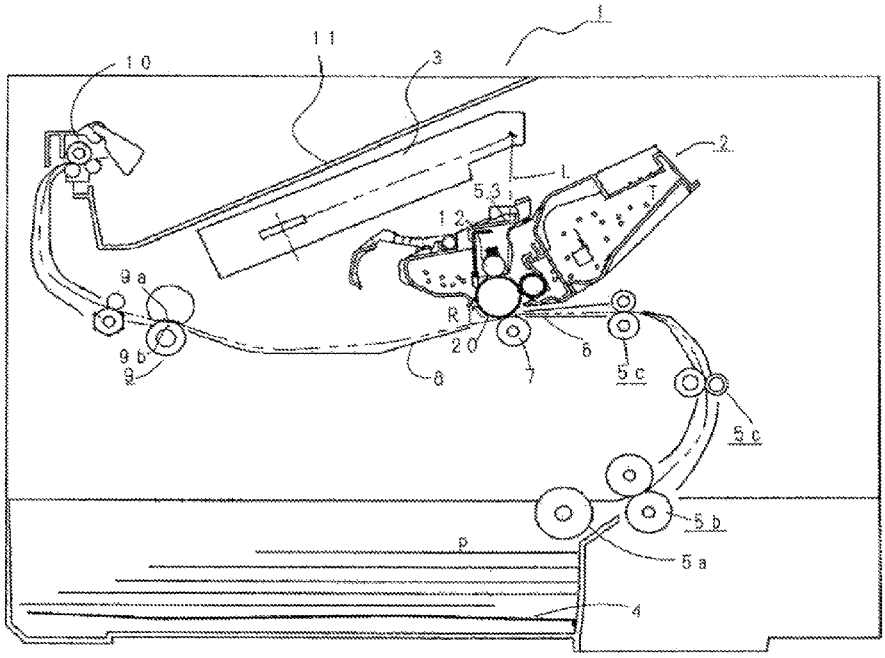
FIG. 1 is a sectional view of a main assembly, and a process cartridge of an image forming apparatus in an embodiment.
Figure 2:
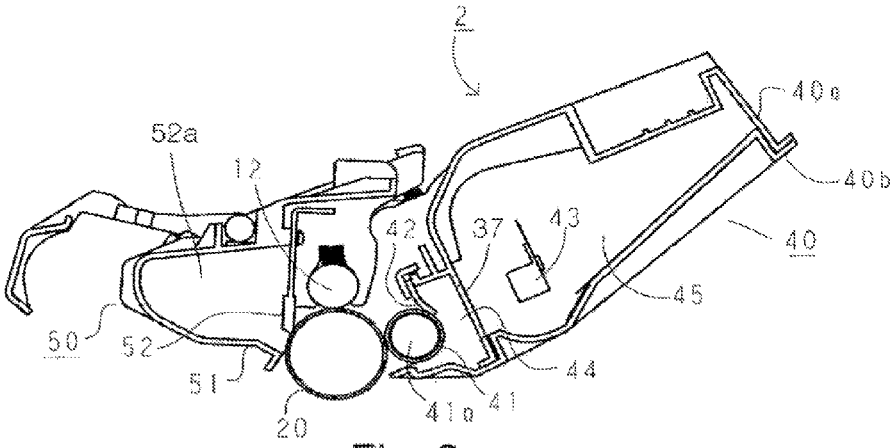
FIG. 2 is an enlarged cross-sectional view of the process cartridge.

FIG. 1 is a sectional view of an image formation main assembly 1 (main assembly), and a process cartridge 2 (cartridge) of an image forming apparatus in an embodiment of the present invention. FIG. 2 is an enlarged cross-sectional view of the cartridge 2. Referring to FIGS. 1-2, a general arrangement, and an image formation process of the image forming apparatus in the present embodiment will be described.

This image forming apparatus is a laser beam printer which utilizes electrophotography, wherein a cartridge 2 is detachably mountable to the main assembly 1. When the cartridge 2 is set to the main assembly 1, an exposure device (laser scanner unit) 3 is disposed on the upper portion of the cartridge 2. The lower portion of the cartridge 2 is provided with a sheet tray 4 which contains recording material (sheet material) P which is the object on which an image is formed. The main assembly 1 is provided with a pick-up roller 5*a*, a feeding roller 5*b*, a feeding roller pair 5*c*, a transfer guide 6, a transfer charging roller 7, a feeding guide 8, a fixing device 9, a discharging roller pair 10, a discharging tray 11, and so on along a feeding direction of the sheet material P.

(Image Formation Process)

The outline of the image formation process will be described. In response to a print start signal, an electrophotographic photosensitive member drum (drum) 20 is rotated at a predetermined peripheral speed (process speed) in a direction of the arrow R1. The a charging roller (charging means, process means) 12 which is supplied with a bias voltage contacts to an outer surface of the drum 20, and the outer surface of by drum 20 is uniformly charged by the charging roller 12.

A laser beam L modulated correspondingly to a serial electrical digital pixel signal of the image information is outputted from the exposure device 3. The laser beam L enters the cartridge 2 through an exposure window 53 of an upper surface of the cartridge 2 to scanningly expose the outer surface of the drum 20 by this, an electrostatic latent image corresponding to the image information is formed on the outer surface of the drum 20. The electrostatic latent image is visualized by a developer T (toner) of a developing device unit 40 into a Toner image.

The charging roller 12 is contacted to the drum 20, and charges the drum 20 electrically. The charging roller 12 is rotated by the drum 20. The developing device unit 40 supplies the toner into the developing zone of the drum 20 to develop the latent image formed on the drum 20.

The developing device unit 40 feeds the toner T in a toner chamber 45 to a toner feeding chamber 44 by the rotation of a stirring member 43. The developing roller (developing means, process means) 41 which is a developer carrying member containing a magnet roller (stationary magnet) 41*a* is rotated, and the toner layer triboelectrically charged by the developing blade 42 is formed on the surface of the developing roller 41. The toner is transferred onto the drum 20 in accordance with the latent image, so that the electrostatic latent image is visualized into a toner image. The developing blade 42 applies the triboelectrical charge while regulating the toner amount on the peripheral surface of the developing roller 41.

On the other h, and in accordance with the output timing of the laser beam L, the paper is fed to the sheet material P accommodated in the lower portion of the main assembly 1 from the sheet tray 4 by the pick-up roller 5*a*, the feeding roller 5*b*, and feeding roller pair 5*c*. The sheet material P is timed and fed to a transfer position between the drum 20, and a transfer charging roller 7 via the transfer guide 6. In the transfer position, the toner image is transferred onto the sheet material P sequentially from the drum 20.

The sheet P onto which the toner image has been transferred is separated from the drum 20, and fed to the fixing device 9 along the feeding guide 8. The sheet material P is passed through a nip formed between a fixing roller 9*a*, and a pressing roller 9*b* which constitute the fixing device 9. The pressing and the heat-fixing process are carried out in the nip so that toner image is fixed on the sheet material P. The sheet material P having been subjected to the image fixing process for the toner image is fed to discharging roller pair 10, and is discharged to the discharging tray 11.

On the other h, and the residual toner remaining on the outer surface of the drum 20 is removed by a cleaning blade (cleaning means, process means) 52 after the transferring 20, and the drum is used for the next image formation which starts with the electrical charging operation. The waste toner removed from the drum 20 is stored in the waste toner chamber 52*a* in the photosensitive member unit 50.

The charging roller 12, the developing roller 41, the cleaning blade 52, and so on are the process means actable on the drum 20, respectively.

(Frame Structure of Process Cartridge)

Figure 3:
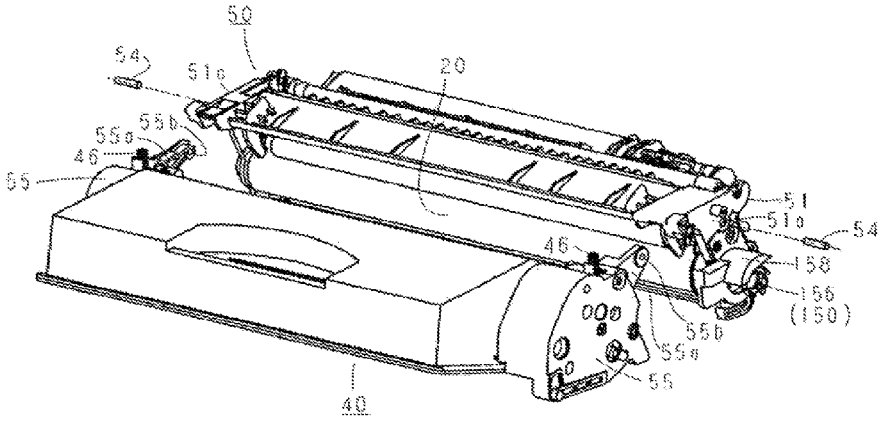
FIG. 3 is a perspective view illustrating a frame structure of the process cartridge.

FIG. 3 is a perspective view illustrating structures of a frame of the cartridge 2.

Referring to FIG. 2 and FIG. 3, the frame structure of the cartridge 2 will be described.

As shown in FIG. 2, the drum 20, the charging roller 12, and the cleaning blade 52 is mounted to the drum frame 51, and constitutes an integral photosensitive member unit 50.

On the other hand, the developing device unit 40 is constituted by the toner chamber 45 which contains the toner, the toner accommodating chamber 40*a* which forms the toner feeding chamber 44, and the cover 40*b*.

The toner accommodating chamber 40*a* and the cover 40*b* is connected relative to each other by the means such as the welding.

As shown in FIG. 3, the cartridge 2 is constituted by connecting the photosensitive member unit 50 and the developing device unit 40 rotatably relative to each other by a connection member 54 of a round pin.

As shown in FIG. 3, the free end of an arm portion 55*a* formed on a side cover 55 provided at each end with respect to the longitudinal direction of the developing device unit 40 (axial direction of the developing roller 41) is provided with a round rotation hole extending in parallel with the developing roller 41 55*b*.

The drum frame 51 has an engaging hole 51*a* for receiving the connection member 54 co-axially with the rotation hole 55*b* when the arm portion 55*a* is inserted in the predetermined position of the drum frame 51.

The photosensitive member unit 50 and the developing device unit 40 are connected with each other rotatably about the connection member 54 by inserting the connection member 54 through both the rotation hole 55*b* and the engaging hole 51*a*.

At this time, a compression coil spring 46 mounted to the base portion of the arm portion 55*a* abuts to the drum frame 51 to urge the developing device unit 40 downwardly.

By this, the developing roller 41 (FIG. 2) is assuredly pressed toward the drum 20.

The spacing members (unshown) are mounted at the opposite ends of the developing roller 41, so that the developing roller 41 is held with predetermined intervals from the drum 20.

(Rotational Force Transmission Method to Process Cartridge)

Figure 4:
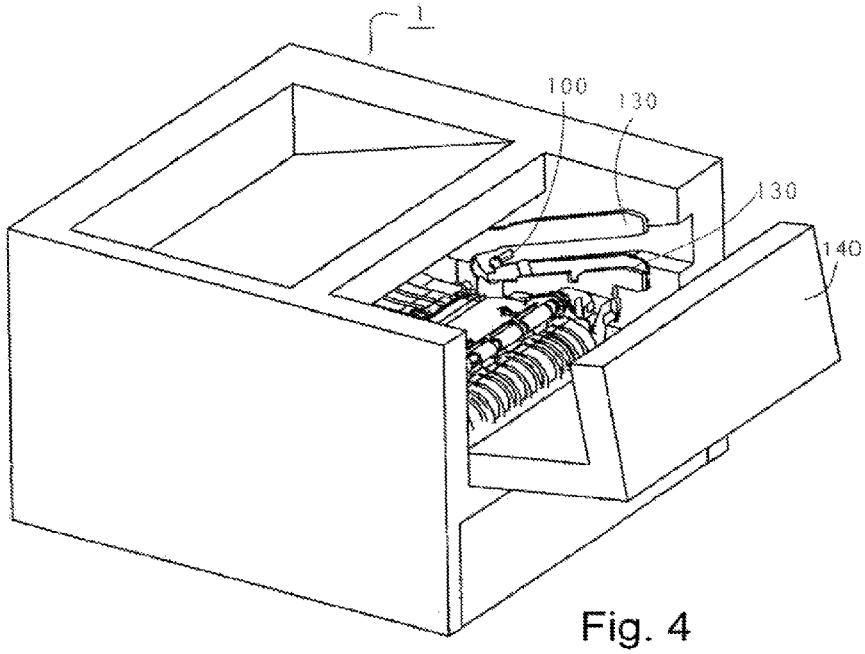
FIG. 4 is a perspective view of the main assembly in the state that an openable and closable door is opened.

FIG. 4 is a perspective view of an inside of the main assembly with the door 140 open.

The cartridge 2 is not mounted.

Referring to FIG. 4, the rotational force transmission method to the cartridge 2 will be described.

As shown in FIG. 4, a guiding rail 130 for the cartridge mounting and demounting is provided in the main assembly 1, and the cartridge 2 is mounted into the inside of the main assembly 1 along a guiding rail 130.

In this case, a drive shaft 100 of the main assembly side and a coupling member 156 (FIG. 3) which is a rotational force transmitting portion of the cartridge 2 connect with each other in interrelation with the mounting operation of the cartridge 2.

By this, the drum 20 receives the rotational force from the main assembly 1 to rotate.

Figure 5:
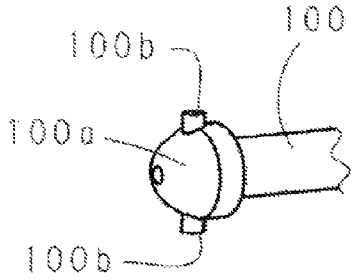
FIG. 5 is a perspective view of a drive shaft of the main assembly.

1>> Drive Shaft 100:

FIG. 5 is a perspective view of the drive shaft 100 of the main assembly side.

The drive shaft 100 is coupled with the drive transmitting means, such as an unshown gear train and the unshown motor provided in the main assembly 1.

The free end portion 100*a* of the drive shaft 100 has a substantial semispherical shape, and is provided with rotational force transmitting pins as the rotational force applying portion 100*b*.

2>> Coupling:

In the state where the cartridge 2 is dismountably mounted to the main assembly 1, the coupling member 156 has the function of receiving a rotational force for rotating the drum 20 from the main assembly 1.

Figure 11:
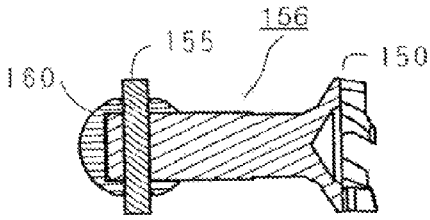
FIG. 11 is a sectional view of the coupling member.
Figure 12:
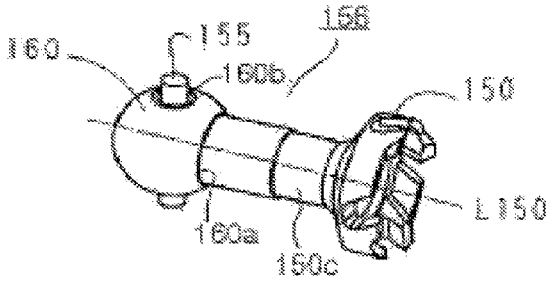
FIG. 12 is a perspective view of the coupling member.

As shown in FIG. 11 and FIG. 12, this coupling member 156 has a rotational force receiving member 150 which has a rotational force receiving portion 150*e* (150*e*1-150*e*4) for receiving the rotational force at the free end portion thereof.

In addition, it has a spherical portion (spherical member) 160 mounted by penetrating the pin 155 through a rear end portion of the rotational force receiving member 150.

Figure 6:
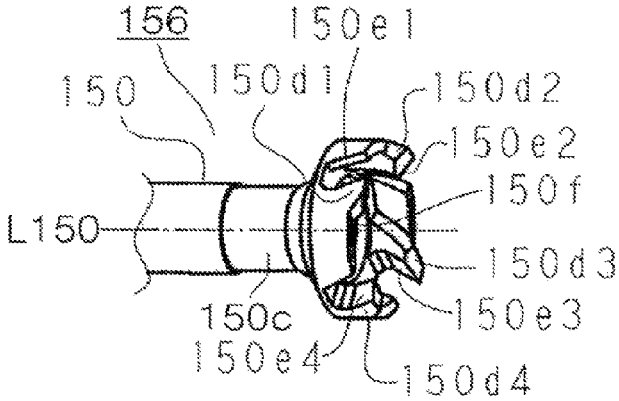
FIG. 6 is a perspective view of a free end portion of a coupling member.

FIG. 6 is a perspective view of the rotational force receiving member 150.

The material of the rotational force receiving member 150 is resin material of the polyacetal, the polycarbonate, PPS, or the like.

However, in order to enhance the rigidity of the rotational force receiving member 150, glass fibers, carbon fibers, and/or the like may be mixed in the resin material in response to the required torque load.

In the case of mixing such a material, the rigidity of the rotational force receiving member 150 can be enhanced.

The rigidity may further be enhanced by inserting a metal member material in the resin material, and the whole rotational force receiving member 150 may be made of metal or the like.

The free end of the rotational force receiving member 150 is provided with a plurality of drive receiving projections 150*d* (150*d*1-150*d*4).

In addition, the drive receiving projection 150*d* (150*d*1-150*d*4) is provided with rotational force receiving portion 150*e* (150*e*1-150*e*4) inclined relative to the axis L150 of the rotational force receiving member 150.

In addition, the inside of drive receiving projection 150*d*1-150*d*4 is provided with a funnel-like funnel 150*f*.

Figure 7:
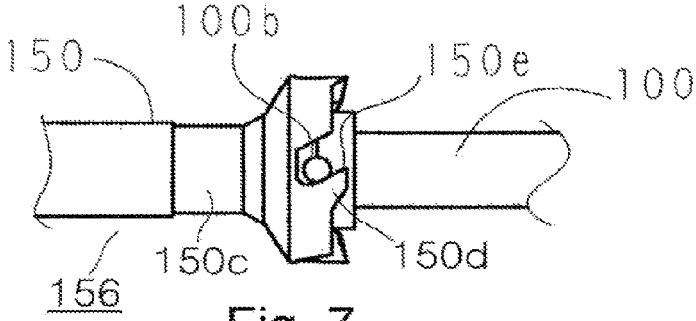
FIG. 7 is an illustration showing the state that the coupling member and the drive shaft are connected with each other.

3>> Connection State Between Drive Shaft 100 and Coupling Member 156:

FIG. 7 is an illustration showing the state that the rotational force receiving member 150 of the coupling member 156 and the drive shaft 100 connects with each other.

Figure 8:
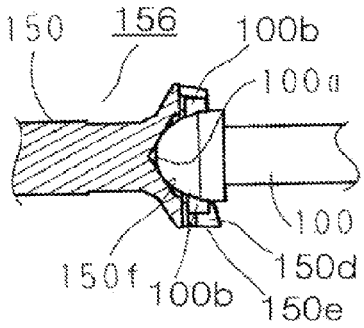
FIG. 8 is a sectional view illustrating the state that the coupling member and the drive shaft are connected with each other.

FIG. 8 is a sectional view illustrating the state that the rotational force receiving member 150 and the drive shaft 100 connect with each other.

Referring to FIG. 7 and FIG. 8, the connection state between the drive shaft, 100 and the coupling member 156 will be described.

The rotational force transmitting pin 100*b* of the drive shaft 100 is in engagement with the rotational force receiving portion 150*e* (150*e*1-150*e*4).

Although it is not visible in FIG. 7, the rotational force transmitting pin 100*b* on the back side is also in engagement with the rotational force receiving portion 150*e*.

In addition, the free end portion 100*a* of the drive shaft 100 is in contact with the recess 150*f* of the rotational force receiving member 150.

The rotational force is transmitted from the rotational force transmitting pin 100*b* to the rotational force receiving portion 150*e* by the drive shaft 100 rotating.

In addition, by the rotational force receiving portion 150*e* inclining relative to the axis L150 of the rotational force receiving member 150, the rotational force receiving member 150 and the drive shaft 100 are attracted relative to each other and the free end portion 100*a* and the recess 150*f* contact them to each other assuredly, so that the stabilized rotational force transmission is accomplished.

Figure 9:
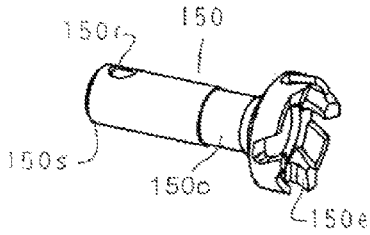
FIG. 9 is a perspective view of a rotational force receiving member which is a component part of the coupling member.
Figure 10:
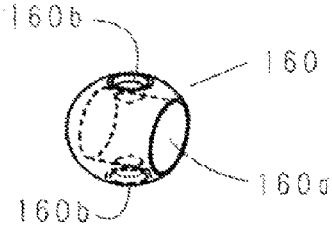
FIG. 10 is a perspective view of a spherical portion which is a component part of the coupling member.

4>> Coupling Member 156 and Connection Part:

FIG. 9 is a perspective view illustrating the rotational force receiving member 150, and FIG. 10 is a perspective view illustrating the spherical portion 160.

FIG. 11 is a sectional view of the coupling member 156, and FIG. 12 is a perspective view of the coupling member 156.

As shown in FIG. 9, the end on the side opposite from the rotational force receiving portion 150*e* of the rotational force receiving member 150 150*s* is provided with a through-hole 150*r*.

As shown in FIG. 10, the spherical portion 160 connected with the rotational force receiving member 150 has the substantial spherical shape and is provided with the rotational force receiving member 150 and the hole for receiving the pin 155 as will be described hereinafter.

A one-end-closed hole 160*a* receives the end 150*s* of the rotational force receiving member 150.

The through-hole 160*b* receives the pin 155 which will be described hereinafter with the hole 160*a*.

As shown in FIG. 11 and FIG. 12, the rotational force receiving member 150 is inserted into the spherical portion 160, and the pin 155 is inserted in the state that the through-hole 150*r* and the through-hole 160*b* are aligned with each other.

In this embodiment, the rotational force receiving member 150 and the one-end-closed-hole 160*a* are engaged with each other with the loose-fit.

The pin 155 and the through-hole 150*r* are engaged with each other with the loose-fit.

The pin 155 and the through-hole 160*b* are engaged with each other with the press-fit.

Accordingly, the pin 155 and the spherical portion 160 are connected with each other integrally.

A part provided by the connection between the rotational force receiving member 150 and the spherical portion 160 is the coupling member 156.

When the rotational force is received from the drive shaft 100, the rotational force receiving member 150 rotates about the axis L150, and the through-hole 150*r* is engaged with the pin 155.

More particularly, the rotational force from the main assembly 1 is converted to the force for rotating the pin 155 about the rotation shaft L150 through the rotational force receiving member 150.

Figure 13:
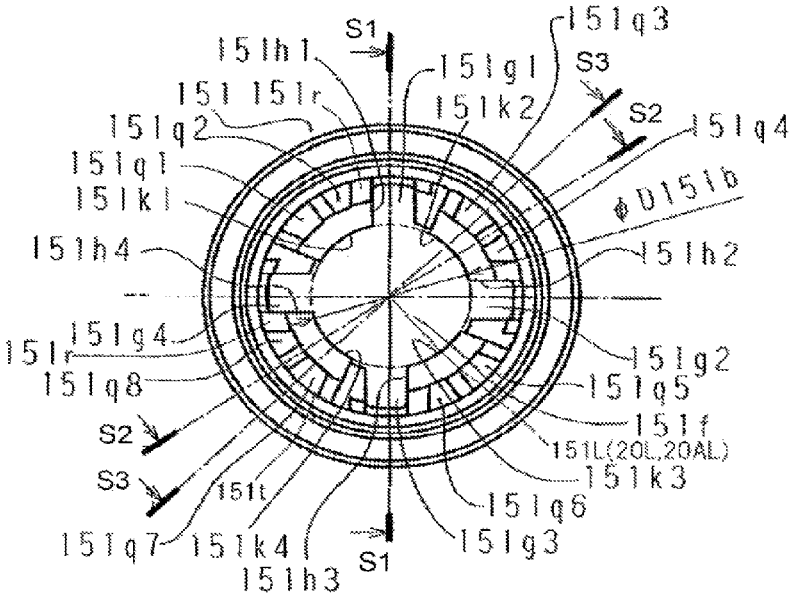
FIG. 13 is an illustration of a drum flange.
Figure 14:
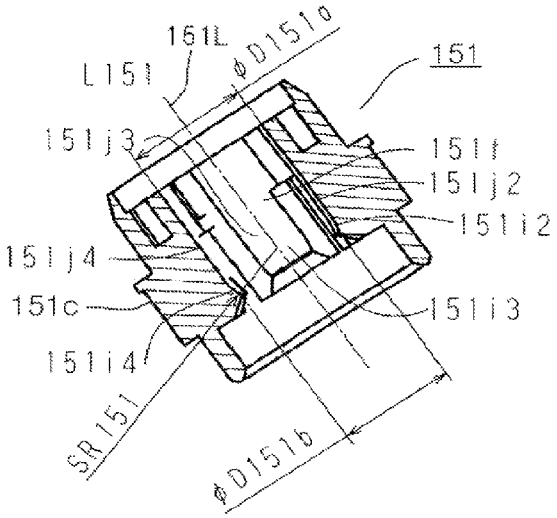
FIG. 14 is a sectional view taken along a line S2-S2 in FIG. 13.

5>> The Rotational Force Transmission to the Drum 20 from the Coupling Member 156:

FIG. 13 is an illustration illustrating the drum flange 151, and FIG. 14 is a sectional view taken along line S2-S2 in FIG. 13.

Figure 15:
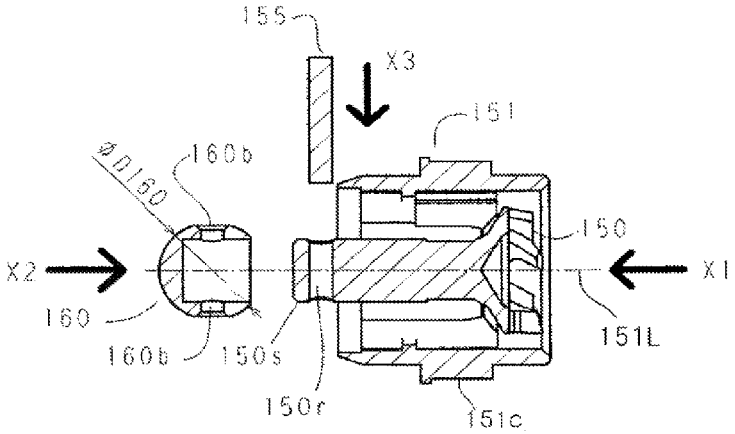
FIG. 15 is a sectional view which illustrates the process in which the rotational force receiving member is assembled into the drum flange, in the section along a line S1-S1 in FIG. 13.

FIG. 15 is a sectional view taken along a line S1-S1 in FIG. 13, illustrating the process in which the rotational force receiving member 150 is assembled into the drum flange 151.

Figure 16:
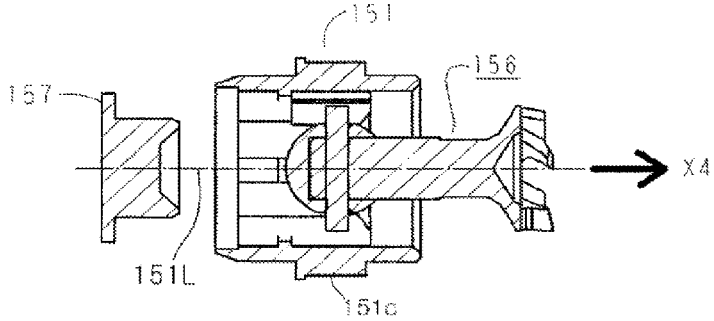
FIG. 16 is a sectional view which illustrates the process in which the coupling member is fixed to the drum flange, in the section taken along a line S1-S1 in FIG. 13.

FIG. 16 shows a sectional view taken along a line S1-S1 in FIG. 13, illustrating the process in which the rotational force receiving member 150 is fixed to the flange 151.

Figure 17:
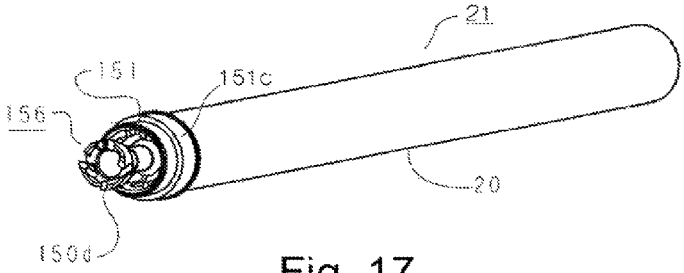
FIG. 17 is a perspective view of the drum unit, as seen from a driving side.

FIG. 17 is a perspective view of the electrophotographic photosensitive drum unit (drum unit) 21, as seen from the driving side (rotational force receiving member 150).

Figure 18:
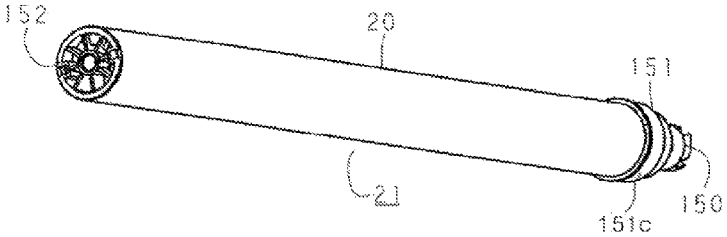
FIG. 18 is a perspective view of the drum unit, as seen from a non-driving side.

FIG. 18 is a perspective view of the drum unit 21, as seen from the non-driving side (longitudinally opposite from the rotational force receiving member 150).

Referring to FIG. 13 and FIG. 14, an example of the drum flange 151 (flange) to which the rotational force receiving member 150 is mounted will be described.

FIG. 13 illustrates the flange 151, as seen from the drive shaft 100 side.

An opening 151*g* (151*g*1-151*g*4) shown in FIG. 13 is a groove which extends in the direction of a rotation shaft of the flange 151.

When the rotational force receiving member 150 is mounted to the flange 151, the pin 155 is received in the either two of openings 51*g*1-151*g*4.

The clockwisely upstream side of openings 151*g*1-151*g*4 is provided with the rotational force transmitting surface (rotational force receiving portion) 151*h* (151*h*1-151*h*4).

When the rotational force is transmitted to the flange 151 from the pin 155, the pin 155 and the rotational force transmitting surface 151*h* contact to each other.

In addition, adjacent to the center axis L151 of the flange 151, a recess (space) 151*f* is formed.

The recess 151*f* provides a space surrounded by the cylindrical surface 151*j* (151*j*1-151*j*4), a retaining portion 151*i* (151*i*1-151*i*4) which is a regulating portion, and the opening 151*k* (151*k*1-151*k*4).

The cylindrical surface 151*j* (151*j*1-151*j*4) is a substantially cylindrical surface which is co-axial with the axis L151 and which is adjacent to the opening 151*g*, and has diameter D151*a*.

The retaining portion 151*i* (151*i*1-151*i*4) is a substantially semispherical surface which continues smoothly with the cylindrical surface 151*j*, and has the radius of SR151.

The opening 151*k* (151*k*1-151*k*4) is positioned at the drive shaft side of the retaining portion 151*i*, and has diameter of D151*b*.

More particularly, the opening 151*k* is a first surface of the regulating portion which continues from the retaining portion 151*i* (regulating portion) and which is extended in the direction away from the coupling member 156 toward the free end of the rotational force receiving member 150 with respect to the longitudinal direction of the drum 20.

In addition, the relation of the spherical portion 160 relative to outside dimension D160 is as follows (FIG. 14, FIG. 15):

$$D151b<D160<D151a=2\times SR151$$

Although the spherical portion 160 can be inserted with the gap G (FIG. 24) into the recess 151*f*, the movement toward the opening 151*k* of the axis L151 is prohibited.

The spherical portion 160 (coupling member 156) does not separate from the flange 151 (process cartridge 2) under the normal service condition by this prohibition.

More particularly, the flange 151 is mounted to the end of the drum 20, and the coupling member 156 is mounted to this flange 151.

In order to mount the coupling member 156, the flange 151 is provided with the regulating portion extended along the inside peripheral surface of the flange 151 (retaining portion 151*i*).

This regulating portion (retaining portion 151*i*) has the gap G relative to the spherical portion 160, and has a nearer configuration to the configuration of the surface of the spherical portion 160 of the rotational force receiving member 150 than a flat plane which is perpendicular to the longitudinal direction of the drum 20 and which passes through the center of the spherical portion 160.

Referring to FIGS. 15 and 16, the process of assembling the rotational force receiving member 150 to the flange 151 and fixing will be described.

The end portion 150*s* is inserted in the direction of an arrow X1 into the flange 151.

Then, the spherical portion 160 is put over the end portion 150*s* in a direction indicated by an arrow X2.

In addition, the through-holes 160*b* of the spherical portion 160 and the through-hole 150*r* of the end portion 150*s* are aligned with each other, and, thereafter, the pin 155 is inserted thereinto in the direction of an arrow X3.

The pin 155 penetrates the through-holes 160*b* and the through-hole 150*r*.

Since the inner diameter of the through-holes 160*b* is smaller than that of the pin 155, there is a frictional force between the pin 155 and the through-holes 160*b*.

In this embodiment, the interference therebetween is about 50 micrometers.

By this, the pin 155 is held without deviation during the ordinary use, and the coupling member 156 constituted by the connection between the rotational force receiving member 150 and the spherical portion 160 is provided.

In addition, the coupling member 156 is moved in a direction X4, and the spherical portion 160 is contacted or approached to the retaining portion 151*i*.

Then, retaining portion material 157 is inserted in the direction indicated by an arrow X4, and is fixed to the flange 151.

Since a play (gap) remains relative to the spherical portion 160, the coupling member 156 can change the orientation.

Referring to FIG. 17 and FIG. 18, the structures of the drum unit 21 will be described.

The flange 151 which has the mounted coupling member 156 is fixed to the end side of the drum 20 so that the drive receiving projection 150*d* is exposed, In addition, the drum flange 152 of the non-driving side is fixed to the other end side of the drum 20.

The fixing method may be the crimping, the bonding, the welding, and so on.

In the state that the driving side of the drum unit 21 is supported by the bearing member 158 (FIG. 3, FIG. 19), and the non-driving side thereof is supported by the drum unit supporting pin 159 (FIG. 19), the drum unit 21 is supported rotatably by the drum frame 51 (FIG. 3).

As has been described hereinbefore, the rotational force from the motor (unshown) of the main assembly 1 rotates the drive shaft 100 through the drive transmitting means, such as the gear of the main assembly 1 (unshown).

The rotational force is transmitted to the cartridge 2 through the rotational force receiving member 150 of the coupling member 156.

In addition, the rotational force is transmitted from the rotational force receiving member 150 to the flange 151 through the pin 155 to apply the rotational force to the drum 20 integrally fixed to the flange 151.

The outside periphery of the flange 151 is provided with a helical gear molded integrally with the flange 151 151*c*.

This gear 151*c* transmits the rotational force received from the drive shaft 100 by the rotational force receiving member 150 to the developing roller 41 (FIG. 2).

More particularly, the outside portion opposed to the retaining portion which is the regulating portion of the flange 151 151*i* is provided with the helical gear 151*c*, and the gear transmits the rotational force received from the main assembly 1 by the coupling member 156 to the developing roller 41.

(Remanufacturing Method of Cartridge)

In the cartridge 2 mounted and used in the main assembly 1 the toner T contained in the toner chamber 45 is consumed in accordance with the repetition of the image formation.

When the toner T is consumed to the degree it becomes impossible to form the image of the quality which satisfies the user of the cartridge 2, it loses the commodity value as the cartridge 2.

In view of this, for example, a means (unshown) for detecting the remainder amount of the toner of the cartridge 2 is provided, and a main assembly control circuit (unshown) compares the detected remaining amount with a predetermined threshold for the cartridge lifetime forenotice and/or the cartridge lifetime warning.

When the detected remaining amount is smaller than the threshold, a display portion (unshown) displays the lifetime forenotice or the lifetime warning of the cartridge 2.

By this, the user is prompted for the preparation for the exchange cartridge 2, and in this manner, the quality of the output images is maintained.

The used-up process cartridge 2 is collected, and the cleaning, the parts replacement, and so on are carried out, and the fresh toner is filled thereinto.

By this, it is remanufactured to reuse.

Here, the remanufacturing method of the used-up cartridge will be described.

Here, the cleaning is carried out by the air suction, the air-blowing, the wet type cleaning, wiping, and so on, for example.

(i) Unit Separating Step:

When the connection member 54 which connects the photosensitive member unit 50 and the developing device unit 40 rotatably relative to each other is pulled out, the developing device unit 40 and the photosensitive member unit 50 are separable from each other (FIG. 3).

(ii) the Disassembling, Cleaning, Parts Replacement, Reassembling of the Photosensitive Member Unit 50:

FIGS. 19-22 are perspective views illustrating processes of disassembling the photosensitive member unit 50.

After separating the photosensitive member unit 50 and the developing device unit 40 from each other, the disassembling, the cleaning, the parts replacement, re-assembly of the photosensitive member unit 50 is carried out.

These operations will be described.

First, referring to FIG. 19, the disassembling of a protecting member 101 and an urging spring 102 will be described.

A shaft portion 101*a* of the protecting member 101 for light shielding and protection of the drum 20 is dismounted with the urging spring 102 from a U-like bearing portion 51*d* of the drum frame 51.

Figure 20:
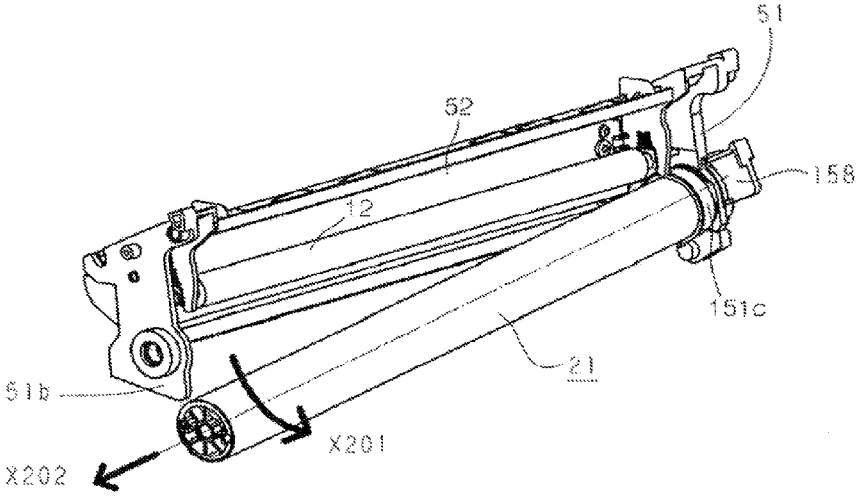
FIG. 20 is a perspective view illustrating a disassembling process of the photosensitive member unit.

Referring to FIG. 20, the dismounting method of the drum unit 21 will be described.

The drum unit 21 is supported by a bearing member 158 and a drum unit supporting pin 159 provided at the respective ends of the photosensitive member unit 50 (drum frame 51).

When the pin 159 is pulled out, the non-driving side (pin side) of the drum unit 21 is disengaged.

The non-driving side wall 51*b* of the drum frame 51 is opened longitudinally outwardly, and simultaneously the bearing member 158 integrally fixed on the driving side wall 51*c* of the drum frame 51 at the driving side is opened longitudinally outwardly.

Figure 19:
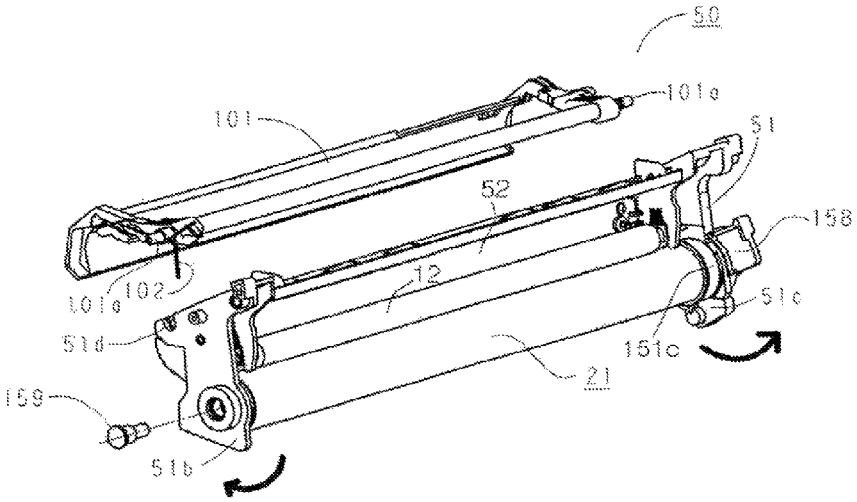
FIG. 19 is a perspective view illustrating a disassembling process of the photosensitive member unit.

These directions are indicated by the arrows in FIG. 19.

Then, the drum unit 21 is rotated in the direction indicated by an arrow X201 about the driving side of the drum unit 21.

Until the non-driving side drum flange 152 (FIG. 18) does not overlap with the non-driving side wall 51*b* with respect to the axial direction (the direction of an arrow X202) of the drum unit 21, it is rotated, and then, the drum unit 21 is easily pulled out in the direction indicated by the arrow X202.

Figure 21:
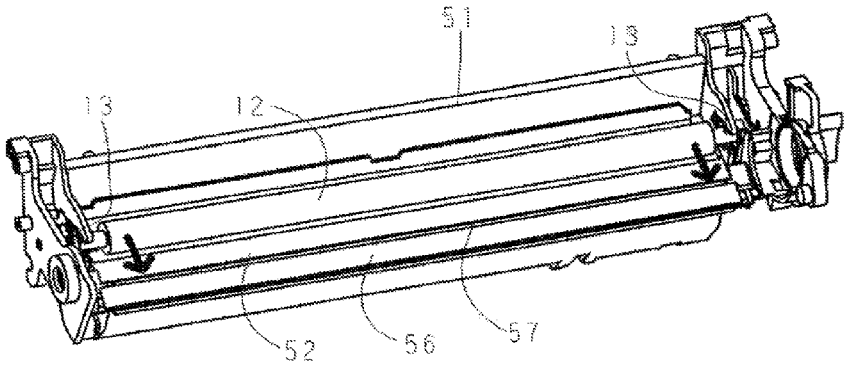
FIG. 21 is a perspective view illustrating a disassembling process of the photosensitive member unit.
Figure 22:
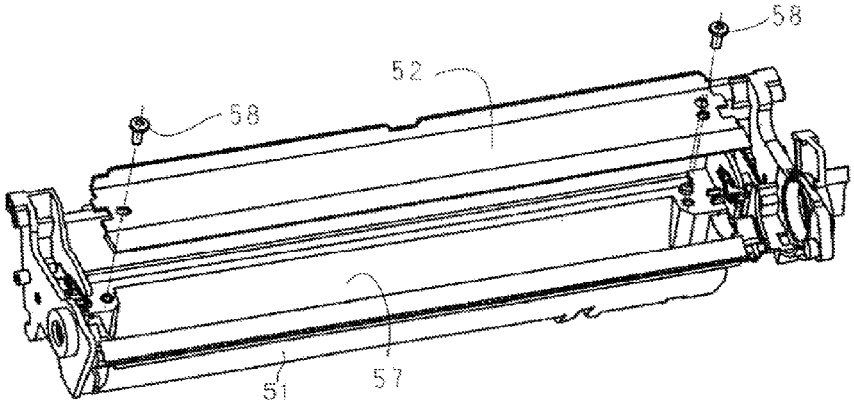
FIG. 22 is a perspective view illustrating a disassembling process of the photosensitive member unit.

Referring to FIG. 21, the removal of the waste toner and the dismounting of the charging roller 12 will be described.

When the drum unit 21 is dismounted, an elongated waste toner collection opening 57 is exposed between a cleaning blade 52 and a waste toner leak preventing sheet 56 mounted to the drum frame 51.

By this, the removal of the waste toner stored in the waste toner chamber 52*a* (FIG. 2) of the drum frame 51 can be accomplished using the waste toner collection opening 57.

This removal is carried out by air suction, blowing, wet type cleaning, wiping, for example.

For the dismounting of the charging roller 12, a roller shaft is dismounted in the direction indicated by the arrow from charging roller bearings 13 on the drum frame side which supports the opposite ends of the roller shaft.

In the state that the charging roller 12 is dismounted, when the removal of the waste toner is carried out, the contamination of the charging roller 12 and the damage of the charging roller 12 at the time of the removal are avoided.

The dismounting of the cleaning blade 52 is carried out by dismounting the two screws 58 which fix the cleaning blade 52 to the drum frame 51.

(iii) Dismounting and Disassembling of Coupling Member 156 (1):

In this embodiment, the rotational force receiving member 150 and the pin 155 of the coupling member 156 are made of metal, in order to accomplish high image quality.

Since they are of metals, the durability is excellent and the repetition usage can be performed, and therefore, it is desirable to dismount and reuse them.

In the method for dismounting the coupling member 156, the manufacturing method of the drum unit 21 described above is carried out inversely.

In other words, the drum 20 is dismounted from the drum unit 21 and then retaining portion material 157 (FIG. 16) is separated from the flange 151.

Subsequently, the pin 155 is pulled out of the coupling member 156.

By this, the rotational force receiving member 150 and the spherical portion 160 can be separated from each other.

The pin 155 and the rotational force receiving member 150 at least are reused (Unshown).

(iv) Dismounting and Disassembling of Coupling Member 156 (2):

As another method, the coupling member 156 is directly dismounted from the drum unit 21.

In this case, since the operation for separating the drum 20 and the retaining member 157 from each other is unnecessary, working efficiency is excellent.

The method of dismounting the coupling member 156 directly from the drum unit 21 will be described.

Figure 23:
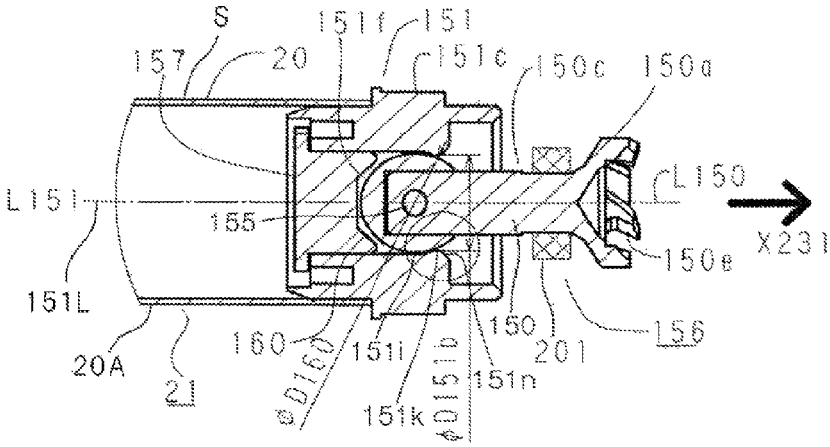
FIG. 23 is a sectional view illustrating a method of dismounting the coupling member directly from the drum unit.

FIG. 23 is a sectional view illustrating the method of dismounting the coupling member 156 directly from the drum unit 21.

The sectional view is a S2-S2 sectional view of FIG. 13.

Figure 24:
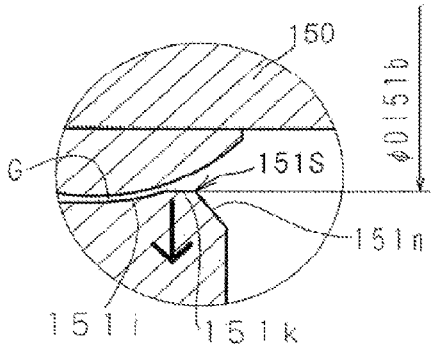
FIG. 24 is a partial enlarged view of the opening portion in FIG. 23.

FIG. 24 is a detailed view of the opening 151*k* portion (surrounded portion) in FIG. 23.

Since the flange 151 has the gear 151*c*, usually, it is made of resin material of a high slidability, such as polyacetal.

Since the spherical portion 160 swings in the recess 151*f* similarly, it is made of a resin members, such as polyacetal, similarly.

More particularly, the spherical portion 160 and the flange 151 (regulating portion 151 the retaining portion as S151*i*) are made of resin material.

As has been described hereinbefore, the outside dimension D160 of the spherical portion 160 is larger than the diameter D151*b* of the opening 151*k*, and therefore, usually, at the time of the usage, it does not separate from the spherical portion 160 (coupling member 156) from the flange 151 (process cartridge 2).

The opening 151*k* is continuing with the retaining portion 151*i*, and inclines away from the coupling member 156 (spherical portion 160).

In more detail, in this embodiment, the difference between the outside dimension of the spherical portion 160 D160 and the diameter of the opening 151*k* D151*b* is approx. 0.4 mm.

However, since the flange 151 and the spherical portion 160 are made of resin material, they relatively easily deform in accordance with the external force.

Therefore, they deform, so that they can pass the spherical portion 160.

Therefore, the coupling member 156 can be pulled out from the flange 151.

First, the member other than the rotational force receiving member 150 of the drum unit 21, i.e., the drum 20 and the flange 151 are held assuredly.

Then, while nipping the driven portion 150*a* and the connecting portion 150*c* which have the rotational force receiving portion 150*e* by a nipping tool 201 such as a pliers or a pincher (cross hatching portion which utilizes connecting portion 150*c* in FIG. 23) (grip step), they are pulled in the direction (direction indicated by the arrow X231) of the axis L150.

By this, the spherical portion 160 contacts to the retaining portion 151*i*.

In addition, when drawing force is increased, the outside dimension D160 of the spherical portion 160 reduces, and, the retaining portion 151*i*, the opening 151*k*, and taper surface 151*n* of the flange 151 deforms outwardly in the radial direction from the axis L151 of the flange 151 (direction indicated by the arrow in FIG. 24).

The taper surface 151*n* of the flange 151 extends to the opening 151*k*, and it inclines away from the coupling member 156 toward the free end side of the coupling member 156 which is in the driven portion side with respect to the axial direction L151.

This taper surface 151*n* is the portion of the second surface of the regulating portion 151 S.

More particularly, the taper surface 151*n* is inclined from the opening which is the first surface of the retaining portion 151*i* which is the regulating portion 151S 151*k*, and is extended away from the coupling member 156 toward the free end of the rotational force receiving member 150 with respect to the longitudinal direction of the drum.

In other words, the spherical portion 160, the retaining portion which is the regulating portion 151 S which projects radially inwardly of the flange 151 sets, the opening 151*k*, and taper surface 151*n* bend, and at the time of the diameter of the opening 151*k* D151*b* and the outside dimension of the spherical portion 160 D160 becoming the same, the coupling member 156 can be taken out from the flange 151 (Dismounting step).

The force required at this time is approx. 9-11 kgf (88-108 Ns).

In order to utilize the pulling force efficiently, it is preferable to carry out the drawing operation in the state that the axis of the flange 151 L151 and the axis of the rotational force receiving member 150 L150 are aligned with each other (positional relation shown in FIG. 23).

The flexibility of the flange regulating portion (retaining portion 151*i*, opening 151*k*, taper surface 151*n*) of 151 depends on the recess 151*q*1-8 which is in the positions outside in the radial direction of the drum flange 151 as seen from the regulating portion part 151S FIG. 13.

In detail, when the recesses 151*q* are large, it separates easily, and it is hard to separate when it is small.

In this embodiment, the dimensional relation in this embodiment is selected such that in the normal use, the retention function is effective, and at the time of dismounting, it can be dismounted by the above described force.

With this method, as described above, the coupling member 156 can be directly dismounted from the drum unit 21.

Accordingly, the operation for separating the drum 20 and the retaining member 157 from each other is unnecessary, and therefore the operational efficiency improves.

In addition, since the operation can be performed with an ordinary tool 201 such as a pliers and a pincher, without using a special tool, the operation is easy.

In addition, manual dismounting is practical, even without using the ordinary tool, in the case where a small number of drum units are disassembled.

Thereafter, the pin 155 is drawn out or pushed out of the spherical portion 160. By this, the coupling member 156 is separable into the rotational force receiving member 150, the pin 155 and the spherical portion 160.

Here, the recesses 151*q* (151*q*1-151*q*8) are provided in the symmetric positions with respect to the axis 151 L of the flange 151.

More particularly, the recess 151*q*1 and the recess 151*q*5, the recess 151*q*2 and the recess 151*q*6, the recess 151*q*3 and the recess 151*q*7, and the recess 151*q*4 and the recess 151*q*8 are provided at the symmetric positions with respect to the axis 151L, respectively.

By such the disposition, when the coupling member 156 is dismounted from the flange 151, the deformation of the regulating portion arises uniformly with respect to the circumferential direction of the flange 151, and therefore, the deformation of the gear portion 151C can be eased.

This applies also in the case of mounting the coupling member 156 to the flange 151.

Figure 34:
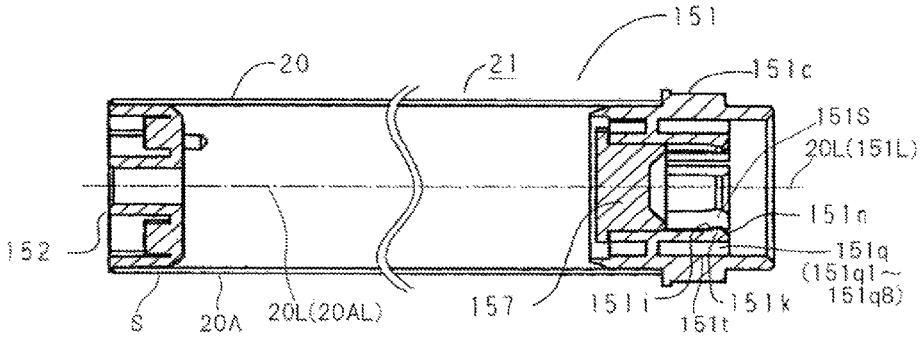
FIG. 34 is a sectional view illustrating a method for reassembling the drum unit.

The axis 151L is aligned with the axis 20L of the drum 20, and with the axis 20AL of the drum cylinder 20A (FIG. 13, FIG. 34). Designated by reference character S is the photosensitive layer.

(v) Dismounting, and Disassembling (3) of Coupling Member 156:

Furthermore, another method for dismounting the coupling member 156 directly from the drum unit 21 will be described. FIGS. 25-27 And FIGS. 29 and 30 are sectional views illustrating a method for dismounting the coupling member 156 directly from the drum unit 21. Here, they are the sectional views along a plane including the axis L151 of the flange 151, and the axis of the pin 155. FIG. 28 is a perspective view for illustrating the state of FIG. 27 in three dimensions. The detailed description will be made with these views.

Figure 25:
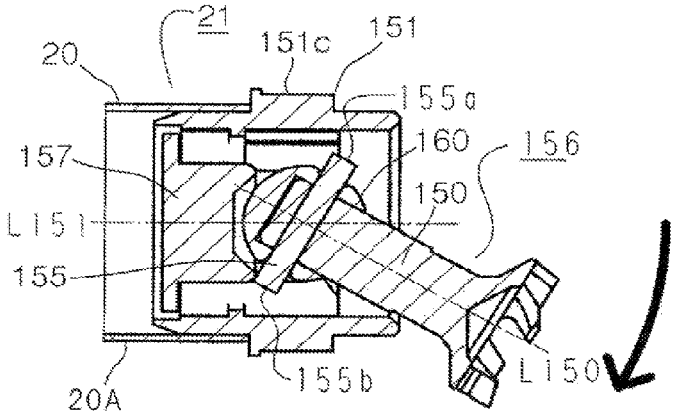
FIG. 25 is a sectional view illustrating a method of dismounting the coupling member directly from the drum unit.

First, the coupling member 156 is rotated relative to the flange 151 in the direction of the arrow in FIG. 25 about the center of the spherical portion 160 (coupling member inclination step). Then, the end surface 155*a* of the pin 155 is exposed.

Figure 26:
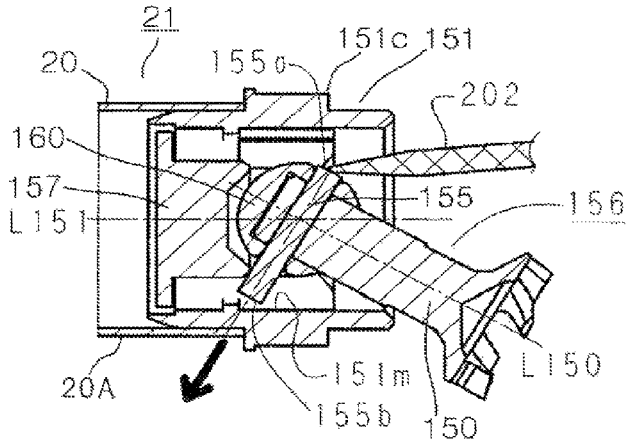
FIG. 26 is a sectional view illustrating a method of dismounting the coupling member directly from the drum unit.

Then, the end surface 155*a* is pushed toward the end surface 155*b* in the direction of the arrow in FIG. 26. More particularly, in the state where the coupling member 156 is inclined through the above described inclination step, the pin 155 of which the one end, and the other end project from the spherical portion 160 is pushed toward the other end from the one end (pin urging step). As has been described hereinbefore, the frictional force is produced between the pin 155, and the spherical portion 160, and therefore, the pin 155 is held, but the pin 155 can be pushed in, without destroying the parts (coupling member 156) by a pressing tool 202 such as a screw driver having a tip. When the end surface 155*a* is pushed in to the neighborhood the surface of the spherical portion 160, the end surface 155*b* of the opposite side moves to the state that a clearance is maintained relative to the inner surface 151*m* of the flange 151.

Figure 27:
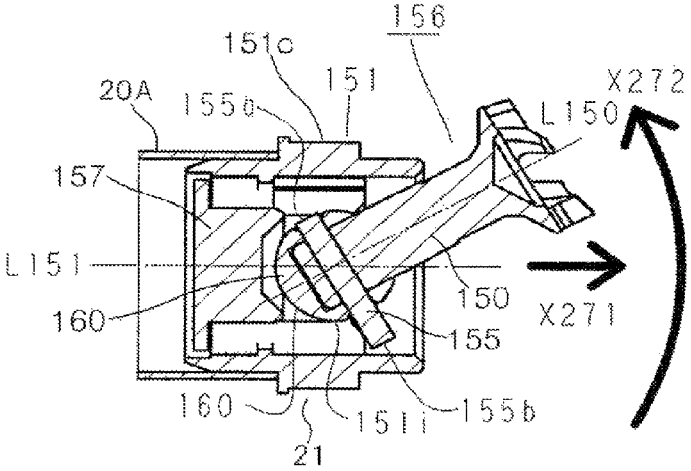
FIG. 27 is a sectional view illustrating a method of dismounting the coupling member directly from the drum unit.
Figure 28:
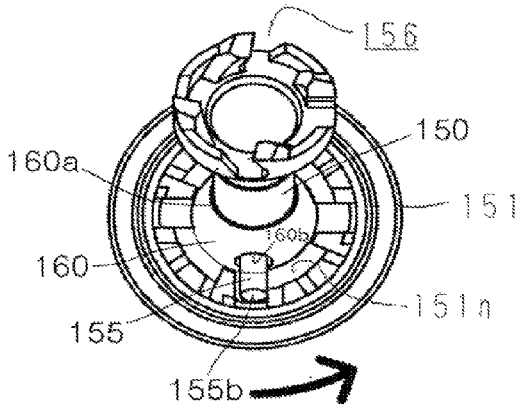
FIG. 28 is a perspective view which illustrates the state of FIG. 27 three-dimensionally.

Then, the coupling member 156 is lightly pulled in the direction of an arrow X271 in FIG. 27. By this, the spherical portion 160 contacts to the retaining portion 151*i*. Furthermore, the coupling member 156 is rotated in the direction of an arrow X272. By this, the end surface 155*b* side is exposed.

Then, when the coupling member 156 inclines, the axis L150, and L151 cross with each other, the coupling member 156 is rotated about the axis L151 of the flange 151 in FIG. 27 in the direction of the arrow in FIG. 28.

Before pushing the end 155*a* of the pin 155 in, the rotational force transmitting surface 151*h* (FIG. 13), and the pin 155 are in contact to each other, but the pin end 155*a* is pushed in, and therefore, it can be rotated, without contacting to the rotational force transmitting surface 151*h*. In addition, the rotation is not restricted in the end 155*b* by providing the clearance between the pin 155, and the tapered surface 151*n*.

Figure 29:
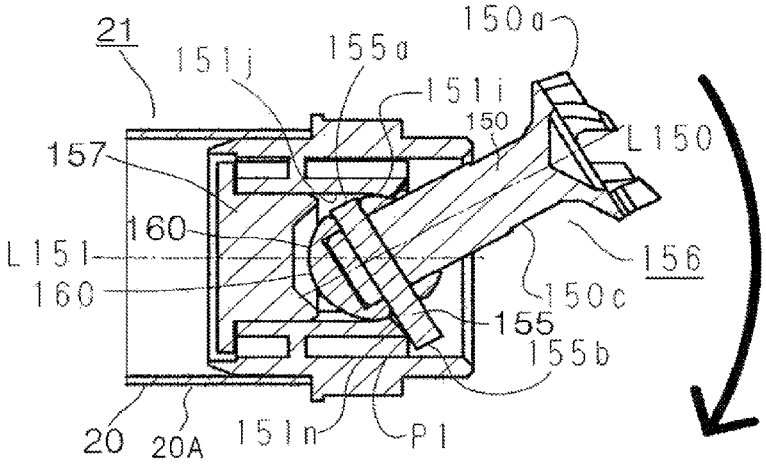
FIG. 29 is a sectional view illustrating a method of dismounting the coupling member directly from the drum unit.
Figure 30:
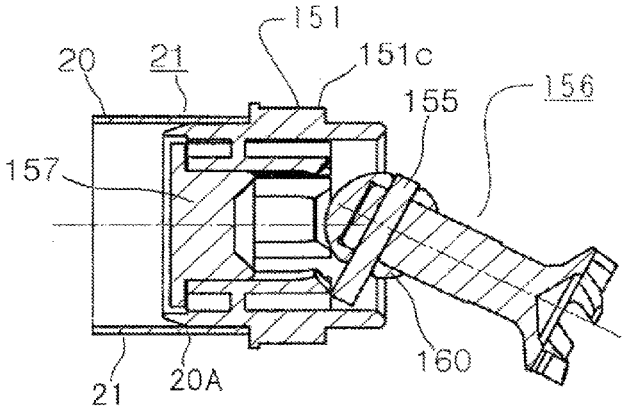
FIG. 30 is a sectional view illustrating a method of dismounting the coupling member directly from the drum unit.

The coupling member 156 is rotated to the position that the pin end 155*b* as seen in the longitudinal direction overlaps with the tapered surface 151*n* of the flange 151 (FIG. 29).

As mentioned above, the a part of the pin which is further projected from the other end portion by being pushed through the above described pin urging step rides on the tapered surface 151*n* which is the second surface of the retaining portion 151*i* which is the regulating portion.

Furthermore, while holding the driven portion 150*a* of the rotational force receiving member 150, a force is applied to the direction of rotating the coupling member 156 in the direction of the arrow in FIG. 29.

When the force is applied with such the positional relation, the driven portion 150*a* is a force application point, the contact points between the pin 155, and the tapered surface 151*n* is a fulcrum P1, and the contact portion between the spherical portion 160, and the retaining portion 151*i* is a point of application.

As shown in FIG. 29, the connecting portion 150*c* of the rotational force receiving member 150 is long, and the distance between the fulcrum P1, and the point of application is shorter than the distance between the force application point, and the fulcrum P1, and therefore, the so-called "lever rule" works. By increasing the force, the outside dimension D160 of the spherical portion 160 at the point of application reduces. And, the retaining portion 151*i*, the opening 151*k*, and the tapered surface 151*n* of the flange 151 outwardly deform with respect to the radial direction of the axis L151 of the flange 151 (direction of arrow in FIG. 24). By this, the spherical portion 160 (coupling member 156) is dismounted from the flange 151. The force required at this time is approx. 8-10 kgf (78-98N).

As described above, the force toward the fulcrum is applied at the free end of the coupling member 156 with the fulcrum at the pin part which rides on the tapered surface 151*n*, so that the coupling member 156 is dismounted from the flange 151 (coupling member dismounting step).

With this method, it is possible to dismount the coupling member 156 directly from the drum unit 21. Accordingly, the operation for separating the drum 20, and the retaining member 157 from each other is unnecessary, and therefore, the operational efficiency is improved. In addition, the operation can be carried out using the ordinary tool 202 such as the screw driver, without using the special tool, and therefore it is excellent in the easiness of the operation. In addition, the force applied until the spherical portion 160 (coupling member 156) separates from the flange 151 (FIG. 30), is small by the "leverage".

(vi) Re-Assembling Method of Drum Unit 21 (1):

A first method is the same as the assembling method of the drum unit 21 described above substantially. In other words, the rotational force receiving member 150 is inserted into the flange 151, and the spherical portion 160 is covered. Then, the rotational force receiving member 150, the spherical member 160, and the pin 155 are integrally connected by the pin 155, and the coupling member 15 is assembled to the flange 151 (FIG. 15). Furthermore, the retaining member 157 is inserted in the direction of the arrow X4, and it is fixed to the flange 151 (FIG. 16). Then, the drum 20, and the flange 151 are connected with each other. Finally, non-driving side drum flange 152 is fixed to the other end portion of the drum 20 (FIG. 18).

At this time, the rotational force receiving member 150 disassembled, and taken out is reused, but the spherical portion 160, and the pin 155 may be reused after checking the degrees of the damage, and deformation.

Figure 31:
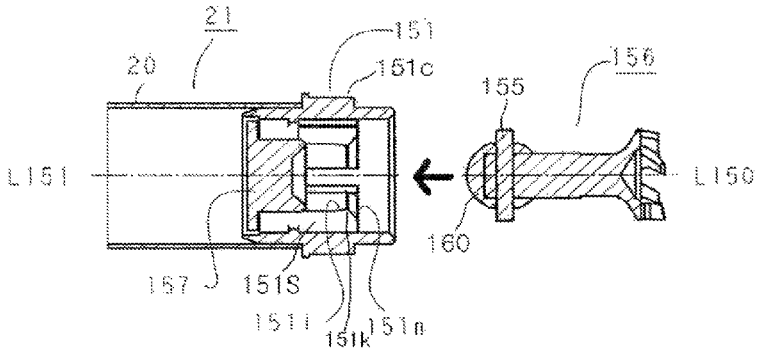
FIG. 31 is a sectional view illustrating a method of reassembling the drum unit.
Figure 32:
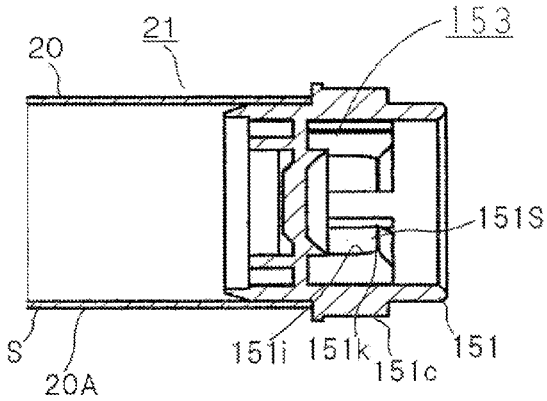
FIG. 32 is a sectional view illustrating a method of reassembling of the drum unit.

(vii) Re-Assembling Method of Drum Unit 21 (2):

FIG. 31, and FIG. 32 are sectional views illustrating the re-assembling method of the drum unit 21 according to another embodiment. Here, FIGS. 31, and 32 are a sectional views taken along a line S1-S1 in FIG. 13. FIG. 34 is a sectional view illustrating a drum unit 21 of the other embodiment.

First, referring to FIG. 31, the description will be made. In the assembling method described above, the coupling member 156 is assembled in the flange 151, but in the present embodiment, the coupling member 156 is assembled independently. At this time, the rotational force receiving member 150 disassembled, and taken out is reused, but the spherical portion 160, and the pin 155 may be reused after checking the degrees of the damage, and deformation.

Apart from it, the retaining member 157 is fixed to the flange 151, and then the drum 20 and the flange 151 are connected with each other. Furthermore, non-driving side drum flange 152 is fixed to the other end portion of the drum 20 (FIG. 18, FIG. 34).

Finally, the coupling member 156 is pushed in in the direction of the arrow in FIG. 31, and the spherical portion 160 is contacted to the tapered surface 151*n*, and when it is further pushed in, the spherical portion 160, and the neighborhood of the tapered surface 151*n* of the flange 151 which is the regulating portion deforms (arrow in FIG. 24) The spherical portion 160 (coupling member 156) can be accommodated in the recess 151*f* by this deformation (FIG. 23).

Here, the easiness of the deformations of the regulating portion 151S (retaining portion 151*i*, the opening 151*k*, tapered surface 151*n*) of the flange 151 depend on the recess 151*q* (FIG. 13, FIG. 34) which is in the outside with respect to the radial direction of the drum flange 151, and the easiness is increased with the size of the recess 151*q*. In this embodiment, the dimensional relations are such that at the time of the usage, it has the retention function normally, and is easily pushed in. It is not inevitable that the regulating portion 151S has the retaining portion 151*i*, the opening 151*k*, and the tapered surface 151*n*. The regulating portion 151S may have the retaining portion 151*i* at least.

Therefore, in mounting the coupling member 156 to the flange 151 the spherical portion 160 contacts to the tapered surface 151*n*, and the center position of the spherical portion 160 is regulated on the axis of the flange 151. By this, the contacted state of the spherical portion 160 relative to the tapered surface 151*n* is uniform. Accordingly, the regulating portion 151S deforms uniformly, and therefore, the spherical portion 160 can be smoothly mounted to the flange 151.

Therefore, even if the flange 151 and the spherical portion 160 are made of the resin material, as with the present embodiment, the damage can be prevented when they contact.

In this embodiment, the coupling member 156 is made of the metal, and therefore, the strength is high.

However, the center position of the spherical portion 160 is set on the axis 151L. Accordingly, the coupling member 156 can be smoothly mounted to the flange 151.

In the spherical portion 160 at least the portion contacted to the regulating portion 151S has the spherical configuration when mounting the coupling member 156 smoothly to the flange 151.

The pin 155 can be inserted into the spherical portion 160 and the rotating force receiving portion 150 without inserting the rotational force receiving member 150 into the flange 151, and therefore, the insertion of the pin 155 is easy. In addition, it is not necessary to mount the parts from the retaining member 157 side, and therefore, it can manufacture as a single part by molding the flange 151, and the retaining member 157 integrally (integral-type flange 153), as shown in FIG. 32. By this, the simplification of the remanufacturing step, and the cost reduction of the product are accomplished.

(viii) Re-Assembling Method of Photosensitive Member Unit 50:

The reassembling of the photosensitive member unit 50 after this is carried out through the reverse process as with the case of the disassembling of the photosensitive member unit 50. More particularly, the cleaning blade 52, the charging roller 12, and the drum unit 21 are mounted in the order named order.

In the above-described reassembling, a new article is used at least as for the drum 20.

Figure 33:
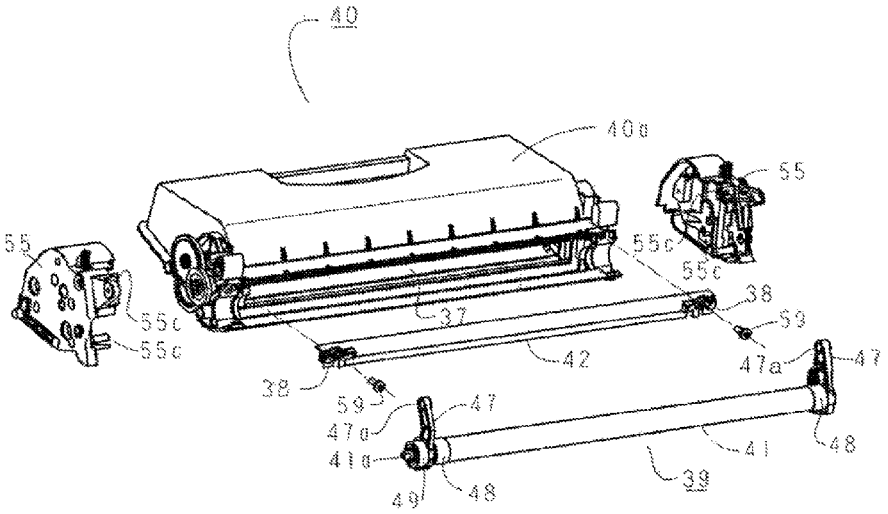
FIG. 33 is a perspective view illustrating a disassembling method for the development unit.

(ix) Disassembling Method, and Re-Assembling Method of Developing Device Unit 40:

FIG. 33 is a perspective view illustrating a disassembling method of the development unit 40. Referring to FIG. 33, the description will be made about the disassembling method of the development unit 40.

First, the side covers 55 at the opposite longitudinal ends of the developing device unit 40 are dismounted. The side cover 55 is fixed to the toner accommodating chamber 40*a* by fastening means such as unshown screws, and therefore, by unfastening them, it can be dismounted from the developing device unit 40.

Then, the developing roller unit 39 is dismounted. The developing roller unit 39 is rotatably supported by the bearing members 47 provided on the opposite ends of the developing roller 41. Each of the upper portion, and the lower portion of the bearing member 47 is provided with two holes 47*a*, and which are engaged with the shaft 55*c* of the side cover 55. Accordingly, when the side covers 55 at both end portions are dismounted, the developing roller unit 39 can be easily dismounted from the development unit 40. Furthermore, the developing roller unit 39 is provided at each end of the developing roller 41 with the spacer member 48 for holding a predetermined gap between the developing roller 41, and the drum 20. In addition, the end of the developing roller 41 is provided with the gear 49 for transmitting the rotational force to the developing roller 41 by engaging with the gear 151*c* of the flange 151.

Then, the developing blade 42 is dismounted. The developing blade 42 is fixed to the toner accommodating chamber 40*a* by the screws 59 at the opposite ends thereof together with the cleaning member 38 for effecting a cleaning operation, while contacting to the end surface of the developing roller 41. Therefore, the developing blade 42 can be dismounted by removing the two screws 59.

A toner refilling step will be described. A toner supply opening 37 (FIG. 2, FIG. 33) communicated with the toner feeding chamber 44, and the toner chamber 45 is exposed, through the above described disassembling step. The toner is filled into the toner chamber 45 through the toner supply opening 37. The toner filling is carried out while holding the developing device unit 40 with the toner supply opening 37 at the upper position, and the toner chamber 45 at the lower position. And, the feeding means such as the funnel is used, and the toner is refilled into the toner supply opening 37.

As described above, after refilling the toner, the developing device unit 40 is assembled. In the case of the reassembling of the developing device unit 40, the operations are carried out through the process opposite from the process of the disassembling step described above. More particularly, after the end of the refilling of the toner, the developing blade 42, the developing roller unit 39, and the side cover 55 are mounted.

(x) Re-Assembling Method of Cartridge 2:

The operations are carried out through the process opposite from the process of the disassembling in the reassembling of the cartridge 2. More particularly, by the connection member 54 (FIG. 3), the photosensitive member unit 50, and the developing device unit 40 are connected rotatably with each other. Finally, in the state that the urging spring 102 is mounted to the protecting member 101 (FIG. 19), the shaft portion 101*a* of the protecting member 101 is inserted into the U-shaped bearing portion 51*d* of the drum frame 51.

The remanufacturing of the process cartridge 2 is completed through the above-described steps.

In the assembling method, the disassembling method, the remanufacturing method of the process cartridge, the steps may simultaneously be carried out by the different operators. In addition, the orders of the steps set forth in the foregoing or in the claims may be properly modified by one skilled in the art.

In addition, the assembly, the disassembling, the remanufacturing of the process cartridge can be carried out by manual operations, automatic operation using automated machines, and combinations of the manual operations, and the automatic operations. In addition, the tools may be used properly.

In addition, in this embodiment, the used process cartridges are collected, and disassembled. And, the parts taken out of the process cartridges by the disassembling are gathered for same parts, respectively. Thereafter, the parts may be re-used, and in some cases, a part of the parts (non-reusable part) may not be used, and a new part may instead be used. In addition, in another type of the present embodiment the used process cartridges are collected, and disassembled. And, a part of parts (non-reusable parts) may not be used, and instead, a reusable part collected from another used cartridge may be reused. Therefore, in the claims, the members, the parts, the portions, and devices with "said or the" covers other members, parts, portion, and devices which have the same function as the very members, parts, portions, and devices.

As has been described hereinbefore, according to the embodiments described above, the process cartridge which is easy in assembling is provided. In addition, the process cartridge which is simple in disassembling is provided. In addition, the simple remanufacturing method of the process cartridge is accomplished. In addition, a remanufacturing method of making reusable a process cartridge from which the developer has been used to such an extent that the images of a quality satisfactory to the user are not formed, is accomplished. In addition, the developer can be refilled easily into the process cartridge from which the toner has been consumed.

The structures of the process cartridge of the foregoing embodiments are summarized as follows.

(1) The process cartridge 2 detachably mountable to the main assembly 1 of the electrophotographic image forming apparatus comprises the electrophotographic photosensitive member drum 20, and the process means 12, 41, 52 actable on the electrophotographic photosensitive member drum. It includes the coupling member 156 for receiving the rotational force for rotating the electrophotographic photosensitive member drum from the main assembly in the state that the process cartridge is dismountably mounted to the main assembly. This coupling member includes the rotational force receiving member 150 which has the rotational force receiving portion 150*e* for receiving the rotational force at the free end portion, and the spherical portion 160 mounted by the pin 155 penetration to the rear end portion of the rotational force receiving member. In addition, it includes the retaining portion 151*i* which is the regulating portion extended along the inner peripheral surface of the flange 151 in order to mount the coupling member 156 to the drum flange 151 mounted to the end of the electrophotographic photosensitive member drum 20. The configuration of the retaining portion 151*i* provides the gap G relative to the spherical portion 160, and is nearer to the configuration extended along the surface of the spherical portion 160 of the free end portion than the flat plane which is perpendicular to the longitudinal direction of the drum 20, and which passes through the center of the spherical portion 160.

With this structure, the process cartridge which can be easily assembled is accomplished. In addition, the process cartridge which can be easily disassembling is accomplished.

More particularly, the coupling member can be directly dismounted from the electrophotographic photosensitive drum unit 21, and therefore, the operation for separating the electrophotographic photosensitive member drum, and the retaining member from each other is unnecessary, by which the operational efficiency is excellent. In addition, the disassembling is possible by the ordinary tools such as the pliers, and the pincher, without using special tools.

(2) regulating portions 151S include the first surface (opening) 151*k* extended away from the coupling member 156 toward the free end portion with respect to the longitudinal direction from the regulating portion 151S.

(3) regulating portions 151S include the second surface (tapered surface) 151*n* bent from the first surface (opening) 151*k*, and the second surface (tapered surface) 151*n* is extended away from the coupling member 156 toward the free end portion with respect to the longitudinal direction.

(4) The outside which faces the retaining portion 151*i* of the flange 151 are provided with the helical gear 151*c*, and the helical gear transmits the rotational force received by the coupling member 156 from the main assembly 1 to the developing roller 41.

The (5) the spherical portion 160, and the regulating portion 151S are made of resin material.

In addition, the dismounting methods of the coupling member 156 of the embodiments described above are summarized as follows.

The coupling member 156 is dismounted from the (6) the drum flange 151 mounted to the electrophotographic photosensitive member drum 20 usable with the process cartridge 2 detachably mountable to the main assembly 1 of the electrophotographic image forming apparatus. In the state in which the process cartridge 2 is dismountably mounted to the main assembly 1 the coupling member 156 receives the rotational force for rotating the electrophotographic photosensitive member drum 20 from the main assembly 1.

The coupling member 156 has the rotational force receiving member 150 which has the rotational force receiving portion 151*e* for receiving the rotational force, ad the free end portion, and the resin spherical portion 160 mounted by the pin 155 penetration to the rear end portion of the rotational force receiving member. And, the coupling member 156 is mounted to the drum flange 151 by the regulating portion (retaining portion) 151*i*, and the configuration of the regulating portion (retaining portion) 151*i* provides the gap G relative to the spherical portion 160, and nearer, than the flat plane which is perpendicular to the longitudinal direction of the electrophotographic photosensitive member drum 20 of flat surface, and is, and which passed through the center of the spherical portion 160, to the configuration extended along the surface of the spherical portion of free end portion.

(i) It has the gripping step of gripping the rotational force receiving member 150 of the coupling member 156 by the tool 201.

(ii) It has the coupling member dismounting step of applying the force to the tool 201 toward the free end portion with respect to the longitudinal direction in the state where the rotational force receiving member 150 is gripped through the gripping step. By this, while elastically deforming the opening 151*k* of the retaining portion 151*i* which is the resin regulating portion, the tapered surface 151*n*, and the resin spherical portion 160, the resin spherical portion 160 is dismounted from the resin material regulating portion (retaining portion 151*i*), by which the coupling member 156 is dismounted.

There is provided a method in which the coupling member 156 is mounted to the drum flange which has the resin material regulating portion provided inside of the flange 151 mounted to the end of the photosensitive drum 20 151S (retaining portion 151*i*, opening 151*k*, tapered surface 151*n*). Here, the regulating portion 151S inwardly projects with respect to the radial direction of the flange 151.

The method includes the gripping step of gripping the rotational force receiving member 150 of the coupling member 156. It includes the coupling member mounting step. In the coupling member mounting step, while elastically deforming the at least one side of the resin regulating portion 151S, and the resin spherical portion 160, the spherical portion 160 is pushed into the inside of the regulating portion 151S with respect to the direction of the axis 20L of the photosensitive drum 20, by which the coupling member 156 is mounted to the flange 151.

In addition, the dismounting step of dismounting the coupling member 156 from the flange 151 has the following steps. It has the gripping step of gripping the rotational force receiving member 150 of the coupling member 156. It has the coupling member dismounting step, wherein in the state where the rotational force receiving member 150 is gripped by the gripping step, the spherical portion 160 is dismounted from the regulating portion 151S, while deforming the at least one side of the regulating portion 151S, and the spherical portion 160 by applying the force toward the free end portion, by which, the coupling member 156 is dismounted from the flange 151.

The regulating portions 151S are provided inside of the flange 151 together with the interval along the circumferential direction of the flange 151. Furthermore, the recess 151*f* is provided inside of the flange 151, and it is provided at the outside of the regulating portion 151S with respect to the radial direction of the flange 151. The outside surface of the flange 151 opposed to the recess 151*f* is provided with the gear portion 151C. The gear portion 151C is provided along the outer surface of the flange 151. The gear portion 151C transmits the rotational force received by the coupling member 156 from the main assembly 1 to the developing roller 41.

According to the dismounting method for this coupling member, it is possible to dismount the coupling member directly from the electrophotographic photosensitive drum unit, the operation for separating the electrophotographic photosensitive member drum, and the retaining member is unnecessary. In addition, the operation is possible by an ordinary tool such as the pliers, and the pincher, without using special tools.

(7) There is provided a method, wherein the coupling member 156 is dismounted from the drum flange 151 mounted to the electrophotographic photosensitive member drum 20 usable with the process cartridge 2 detachably mountable to the main assembly 1 of the electrophotographic image forming apparatus. The coupling member 156 receives the rotational force for rotating the electrophotographic photosensitive member drum 20 from the main assembly 1 in the state in which the process cartridge 2 is dismountably mounted to the main assembly 1. The coupling member 156 has the rotational force receiving member which has the rotational force receiving portion for receiving the rotational force at the free end portion, and the spherical portion mounted at the rear end portion of the rotational force receiving member by the penetration of the pin 155.

(i) It has the inclination step of inclining the coupling member 156 with respect to the rotation axis of the drum flange 151.

(ii) It has the pin urging step of pushing the pin 155 of which the one end, and the other end thereof project from the spherical portion 160 toward the other end from the one end in the state of the coupling member 156 being inclined through the inclination step.

(iii) It has the pin riding step of making a part of the pin which is further projected from the other end portion by being pushed by the pin urging step ride on the second surface (tapered surface) 151*n* of the regulating portion provided along the inner peripheral surface of the drum flange 151. Here, the retaining portion 151*i* as the regulating portion provides the gap G relative to the spherical portion 160, and the configuration thereof is nearer, than the flat plane which is perpendicular to the longitudinal direction of the photosensitive drum 20, and, and which passes through the center of the spherical portion 160, to the configuration extended along the surface of the spherical portion of the free end portion. And, the regulating portion 151S is extended from the retaining portion 151*i*, and it has the first surface (opening) 151*k* extended away from the coupling member 156 toward the free end portion with respect to the longitudinal direction. The second surface (tapered surface) 151*n* is bent from the first surface (opening) 151*k*, and is extended away from the coupling member 156 toward the free end portion with respect to the longitudinal direction.

(iv) It has the coupling member dismounting step of applying the force toward a part of the pin which rides, at the free end of the coupling member 156, on the second surface, and dismounting the coupling member 156 from the drum flange 151.

According to the dismounting method for the coupling member of the embodiments described above, the coupling member can be dismounted directly from the electrophotographic photosensitive drum unit. Therefore, the operation for separating the electrophotographic photosensitive member drum and the retaining member is unnecessary, and therefore, the disassembling operational efficiency is excellent. In addition, without using special tools, the operation is possible using an ordinary tool such as pliers, pincher, and so on, and therefore, the operation is easy. By utilizing the leverage, the force required to dismount the coupling member directly is small.

In addition, when the structures of the electrophotographic photosensitive drum unit 21 of the embodiments described above are summarized as follows.

(8) electrophotographic photosensitive member drum 20 is used in the electrophotographic photosensitive drum unit 21 usable with the process cartridge 2 detachably mountable to the main assembly 1 of the electrophotographic image forming apparatus. It has the coupling member 156 for receiving the rotational force for rotating the photosensitive drum 20 from the main assembly 1, in the state that the process cartridge 2 is dismountably mounted to the main assembly 1. The coupling member 156 has the rotational force receiving member 150 which has the rotational force receiving portion 151*e* for receiving the rotational force at the free end portion, and the spherical portion 160 mounted by the penetration of the pin 155 at the rear end portion of the rotational force receiving member 150. And, the coupling member 156 is mounted to the flange 151 mounted to the end of the photosensitive drum 20 by the regulating portion 151S (retaining portion 151*i*). The regulating portion 151S (retaining portion 151*i*) is provided along the inner peripheral surface of the flange 151 in order to mount the coupling member 156 to the flange 151 mounted to the end of the photosensitive drum 20. In addition, the regulating portion 151S (retaining portion 151*i*) provides the gap relative to the spherical portion, and the configuration thereof is nearer, than the flat plane which is perpendicular to the longitudinal direction of the photosensitive drum 20, and, and which passes through the center of the spherical portion 160, to the configuration extended along the surface of the spherical portion 160 of the free end portion 160.

As has been described hereinbefore, the structure of the drum unit 21 is as follows.

First, the coupling member 156 is mountable to the drum unit 21. And, the coupling member 156 has the rotational force receiving member 150 which has the rotational force receiving portion 151*e* for receiving the rotational force at the free end portion, and the spherical portion 160 mounted by the penetration of the pin 155 at the rear end portion of the rotational force receiving member 150 in order to rotate the drum 20 from the main assembly 1 of the electrophotographic image forming apparatus.

And, the drum unit 21 has the cylinder 20A which is provided with the photosensitive layer S at the peripheral surface, and the drum flange 151 provided at the end of the cylinder 20A. The drum flange 151 has the resin material regulating portion 151S which inwardly projects with respect to the radial direction of the drum flange 151 in the inside of the drum flange 151. The regulating portion 151S prevents the spherical portion 160 from moving in the longitudinal direction of the drum unit 21, when the coupling member 156 is mounted. And, the regulating portions 151S are provided with the intervals along the circumferential direction in the inside of the flange 151. In addition, the drum flange 151 has the recess 151*q* (151*q*1 to 151*q*8) provided in the regulating portion 151S at the outside with respect to the radial direction of the flange 151, wherein the recess 151*q* facilitate or permits the regulating portion 151S to outwardly deform with respect to the radial direction of the flange 151. In addition, the flange 151 has a plurality of rotational force transmitting surface (rotational force transmitted portion) 151*h* (151*h*1-151*h*4) which are provided between the regulating portions 151S in order to receive the rotational force from the pin 155.

In addition, the resin material regulating portions 151S are provided at the same positions as the gear portion 151C with respect to the longitudinal direction of the cylinder 20A in the resin flange 151, and they are disposed with the intervals along the circumferential direction of the cylinder 20A. And, in the regulating portion 151S, the free end portion with respect to the longitudinal direction of the cylinder 20A inwardly projects with respect to the radial direction of the flange 151. In addition, the recess 151*q* (151*q*1 to 151*q*8) is provided between the regulating portion 151S, and the inner surface 151*t* (FIG. 13, FIG. 34) of the flange 151 with respect to the radial direction. And, the recess 151*q* facilitates or permits the regulating portion 151S to outwardly deform with respect to the radial direction.

Here, the regulating portion 151S outwardly deforms easily with respect to the radial direction by the provision of the recess 151*q*. In addition, thereafter, the regulating portion 151S which deformed is restored.

In addition, designated by 151*r* (FIG. 13) is the connecting portion for connecting the regulating portion 151S, and the inner surface 151*t* (FIG. 13, FIG. 34) of the flange 151 with each other. The recess 151*q* is provided between the connecting portions 151*r*. In other words, the connecting portion 151*r*, and the recess 151*q* are provided by turns along the circumferential direction of the flange 151. Therefore, the regulating portion 151S deforms easily.

In addition, the coupling member 156 is mounted to the flange 151. The coupling member 156 receives the rotational force to be transmitted from the main assembly 1 to the flange 1. The coupling member 156 has the rotational force receiving member 150 which has the rotational force receiving portion 150*e* (150*e*1 to 150*e*4) for receiving the rotational force at the free end portion, and the spherical portion 160 mounted by the penetration of the pin 155 at the rear end portion of the rotational force receiving member 150. In the state that the coupling member 156 is mounted to the flange 151, the pin 155 is movable in the circumferential direction, and the longitudinal direction of the cylinder between the regulating portion 151S, and the regulating portion 151S provided along the circumferential direction of the flange 155. In addition, the coupling member 156 is revolvable relative to the flange 151 in the state in which the spherical portion 160 is movable in the circumferential direction, and is regulated in the movement in the longitudinal direction by the regulating portion 151S. More particularly, the coupling member 156 is mounted revolvably to the flange 151 in the state that the spherical portion 160 is movable within the limits that the pin 155 is regulated in the movement by the regulating portion 151S in the circumferential direction, and it is regulated in the movement by the regulating portion 151S in the longitudinal direction.

According to the drum unit 21 described above, the dismounting of the coupling member 156 is easy.

According to the drum unit 21 described above, the mounting of the coupling member 156 is easy.

According to the structure of the drum unit 21, it is possible to dismount the coupling member 160 directly from the drum unit 21, and the operation for separating the drum 20, and the retaining member from each other is unnecessary, and therefore, the operational efficiency is excellent. In addition, since the operation is possible by an ordinary tool such as pliers, a pincher, and so on, without using special tools, it is advantageous in the easiness of the operation.

(9) regulating portions 151S (retaining portion 151*i*) have the first surface (opening) 151*k* extended away from the coupling member 156 toward the free end portion with respect to the longitudinal direction from the retaining portion 151*i* as the regulating portion 151S.

(10) regulating portions have the second surface (tapered surface) 151*n* bent from the first surface (opening) 151*k*, and it is extended away from the coupling member 156 toward the free end portion with respect to the longitudinal direction.

(11) the outside which faces the retaining portion 151*i* of the drum flange 151 is provided with the helical gear 151*c*, and the helical gear transmits the rotational force received by the coupling member 156 from the main assembly 1 to the developing roller 41.

According to the embodiments described above, an easy dismounting method for the coupling member can be provided.

According to the embodiment described above, an easy mounting method for the coupling member can be provided.

According to the embodiments described above, the electrophotographic photosensitive drum unit from which the coupling member can be easily dismounted, can be provided.

According to the embodiments described above, the electrophotographic photosensitive drum unit to which the coupling member can be easily mounted can be provided.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 207291/2008 filed Aug. 11, 2008 which is hereby incorporated by reference.

What is claimed is:

1. An electrophotographic photosensitive drum unit comprising:

(a) a cylinder having a photosensitive layer at an outer periphery thereof; and (b) a drum flange provided at one end of the cylinder, the drum flange including at least two projections provided inside of the drum flange and projected radially inwardly of the drum flange, with a space diametrically between the two projections, wherein each of the two projections projects radially inwardly of the drum flange to a greater extent at a position farther from the cylinder than it does at a position closer to the cylinder, and wherein each of the two projections is provided with a recess to facilitate deformation of the projection.

2. A drum unit according to claim 1, wherein each of the two projections extends radially inwardly of the drum to the greatest extent at an outer end of the projection in a longitudinal direction of the cylinder.

3. A drum unit according to claim 1, further comprising a gear portion provided along an outer surface of the drum flange.

4. A drum unit according to claim 3, wherein the two projections are provided at substantially the same position as the gear portion with respect to a longitudinal direction of the cylinder.

5. A drum unit according to claim 1, wherein the drum flange includes more than two projections provided inside of the drum flange and projected radially inwardly of the drum flange, and each projection is circumferentially spaced apart from each adjacent projection.

6. A drum unit according to claim 1, further comprising a coupling member engaged with the drum flange so that an axis of the coupling member is inclinable with respect to an axis of the cylinder.

7. A drum unit according to claim 6, wherein the coupling member includes a first end portion engaged with the drum flange, a second end portion, and a connecting portion connecting the first end portion and the second end portion, and the space diametrically between the two projections is narrower than a maximum width of the first end portion.

8. A drum unit according to claim 7, wherein the space diametrically between the two projections is wider than a maximum width of the connecting portion.

9. A drum unit according to claim 1, wherein each of the two projections is provided with a plurality of recesses.

* * * * *